US007435202B2

(12) United States Patent
Daly et al.

(10) Patent No.: US 7,435,202 B2
(45) Date of Patent: Oct. 14, 2008

(54) ELLIPTICAL STEP DISTANCE MEASUREMENT

(75) Inventors: Juliette C. Daly, Chicago, IL (US); John M. Rogus, Skokie, IL (US); John J. Hsing, Chicago, IL (US); Gregory Joseph, Naperville, IL (US)

(73) Assignee: Brunswick Corporation, Lake Forest, IL (US)

( * ) Notice: Subject to any disclaimer, the term of this patent is extended or adjusted under 35 U.S.C. 154(b) by 450 days.

(21) Appl. No.: 10/787,788

(22) Filed: Feb. 26, 2004

(65) Prior Publication Data

US 2005/0209056 A1 Sep. 22, 2005

(51) Int. Cl.
*A63B 22/06* (2006.01)
*A63B 71/00* (2006.01)

(52) U.S. Cl. ..... 482/52; 482/8; 482/3; 482/5

(58) Field of Classification Search ..... 482/1–9, 482/52, 54, 57, 70, 79–80
See application file for complete search history.

(56) References Cited

U.S. PATENT DOCUMENTS 4,408,613 A * 10/1983 Relyea ..... 600/483
5,067,710 A * 11/1991 Watterson et al. ..... 482/3
5,135,447 A * 8/1992 Robards et al. ..... 482/52
5,149,084 A * 9/1992 Dalebout et al. ..... 482/3
5,478,295 A * 12/1995 Fracchia ..... 482/7
5,785,632 A * 7/1998 Greenberg et al. ..... 482/5
6,458,060 B1 * 10/2002 Watterson et al. ..... 482/54
6,689,020 B2 * 2/2004 Stearns et al. ..... 482/52
6,997,852 B2 * 2/2006 Watterson et al. ..... 482/1
7,270,628 B2 * 9/2007 Campanaro et al. ..... 482/95

* cited by examiner

*Primary Examiner*—Steve R Crow
(74) *Attorney, Agent, or Firm*—Michael B. McMurry

(57) ABSTRACT

In an elliptical step exercise apparatus distance traveled can be approximated by determining the portion of the ellipse traversed by a foot pedal where the user applies force to the pedal. This portion can be considered equivalent to the amount of foot travel on a treadmill and modified as a function of speed to simulate the gait of a user at various speeds so as to provide an approximation of the distance traveled by a user as if he were running on a treadmill. This process can be further modified for use with an elliptical exercise apparatus where the stride length can be changed such that the simulated distance will be increased with increased stride length.

8 Claims, 16 Drawing Sheets

10
34
38
68
40
44
46
12
80
82
32
50
154
84
42
86
510
48
88
90
RPM
96
LOAD RESISTORS
98
110
CONSOLE
MESSAGE CENTER
100
92
102
POWER CONTROL BOARD
MICROPROCESSOR
94
SPEAKER
122
LED DISPLAY
DATA INPUT CENTER
POWER TRANSFORMER ASSEMBLY
106
104
136
152
HEALTH CLUB COMMUNICATIONS SYSTEM BOARD
148
146
162
150
TELEMETRY RECEIVER
HEART RATE DIGITAL SIGNAL PROCESSOR BOARD
144
144'
HEART RATE SENSING PAD
HEART RATE SENSING PAD
140
140'
164
CENTRAL COMPUTER SYSTEM

ELLIPTICAL STEP DISTANCE MEASUREMENT

FIELD OF THE INVENTION

This invention generally relates to elliptical step exercise equipment and in particular to mechanisms for computing simulated distances traveled by such elliptical exercise equipment.

BACKGROUND OF THE INVENTION

There are a number of different types of exercise apparatus that exercise a user's lower body by providing a circuitous stepping motion. These elliptical stepping apparatus provide advantages over other types of exercise apparatuses. For example, the elliptical stepping motion generally reduces shock on the user's knees as can occur when a treadmill is used. In addition, elliptical stepping apparatuses exercise the user's lower body to a greater extent than, for example, cycling-type exercise apparatuses. Examples of elliptical stepping apparatuses are shown in U.S. Pat. Nos. 3,316,898; 5,242,343; 5,383,829; 5,499,956; 5,529,555; 5,685,804; 5,743,834; 5,759,136; 5,762,588; 5,779,599; 5,577,985; 5,792,026; 5,895,339; 5,899,833; 6,027,431; 6,099,439; 6,146,313; and German Patent No. DE 2 919 494.

Most aerobic type exercise equipment such as exercise bicycles, treadmills and elliptical step apparatus calculate and display various exercise parameters such as elapsed time, calories burned and distance traveled. Because users frequently cross train on these types of exercise equipment, many of these users considered it useful to have a common workout parameter that the user can use to measure a workout. Distance traveled is a desirable parameter especially for people who are interested in training for races such as marathons. However, unlike treadmills and exercise bicycles, the user's foot motion on an elliptical apparatus is not directly translatable into distance. There are existing elliptical apparatus that do display distance traveled but the calculation of distance tends to be arbitrary making it difficult for a user to use distance as a reliable measure of a workout. Moreover, the display of distance on these machines in many cases is unitless further degrading the value of the information displayed.

SUMMARY OF THE INVENTION

It is therefore an object of the invention to calculate and display on an elliptical stepping apparatus an indication of distance traveled using the biomechanics of walking and running to simulate the actual amount of ground covered by someone using the apparatus.

A further object of the invention is to calculate and display on an elliptical stepping apparatus a indication of distance traveled using a portion of the perimeter of the ellipse traversed by each foot that corresponds to an estimate of the ground contact by that foot for a similar walking or running motion.

Another object of the invention is to calculate and display on an elliptical stepping apparatus a indication of distance traveled using the force applied to the foot pedals of the apparatus during the stepping motion to obtain an estimate of the ground contact for corresponding walking or running motions and multiplying the resulting contact length by the rotational speed of the apparatus and the elapsed time of the exercise to obtain the distance traveled during that time. Compensation for the differences in stride in walking, jogging and running can be provided by a multiplier that effectively varies the computed distance traveled as a function of the rotational speed of the apparatus. Since the amount of travel to contact distance tends to increase as walking or running speed increases, the multiplier can be used to increase the distance traveled as a function of increasing apparatus speed.

An additional object of the invention is to calculate and display on an elliptical stepping apparatus an indication of distance traveled by using a linear equation that approximates the distance traveled as computed by estimating the ground contact times the speed of the apparatus modified by a multiplier that compensates for change of stride for varying stepping speeds.

A further object of the invention is to calculate and display on an elliptical stepping apparatus having a variable stride length an indication of distance traveled using the biomechanics of walking and running to simulate the actual amount of ground covered by someone using the apparatus. In one implementation, the distance traveled is calculated by using a linear equation that approximates the distance traveled as computed by estimating the ground contact times the speed of the apparatus where the slope of the linear equation is increased for increasing stride lengths.

Another object of the invention is to provide an elliptical stepping apparatus having a dynamic link mechanism for implementing a variable stride length.

A still further object of the invention is to provide an elliptical stepping apparatus having a variable stride length mechanism that includes a mechanism for providing an indication of the stride length of the apparatus.

DETAILED DESCRIPTION OF THE INVENTION

Figure 1:
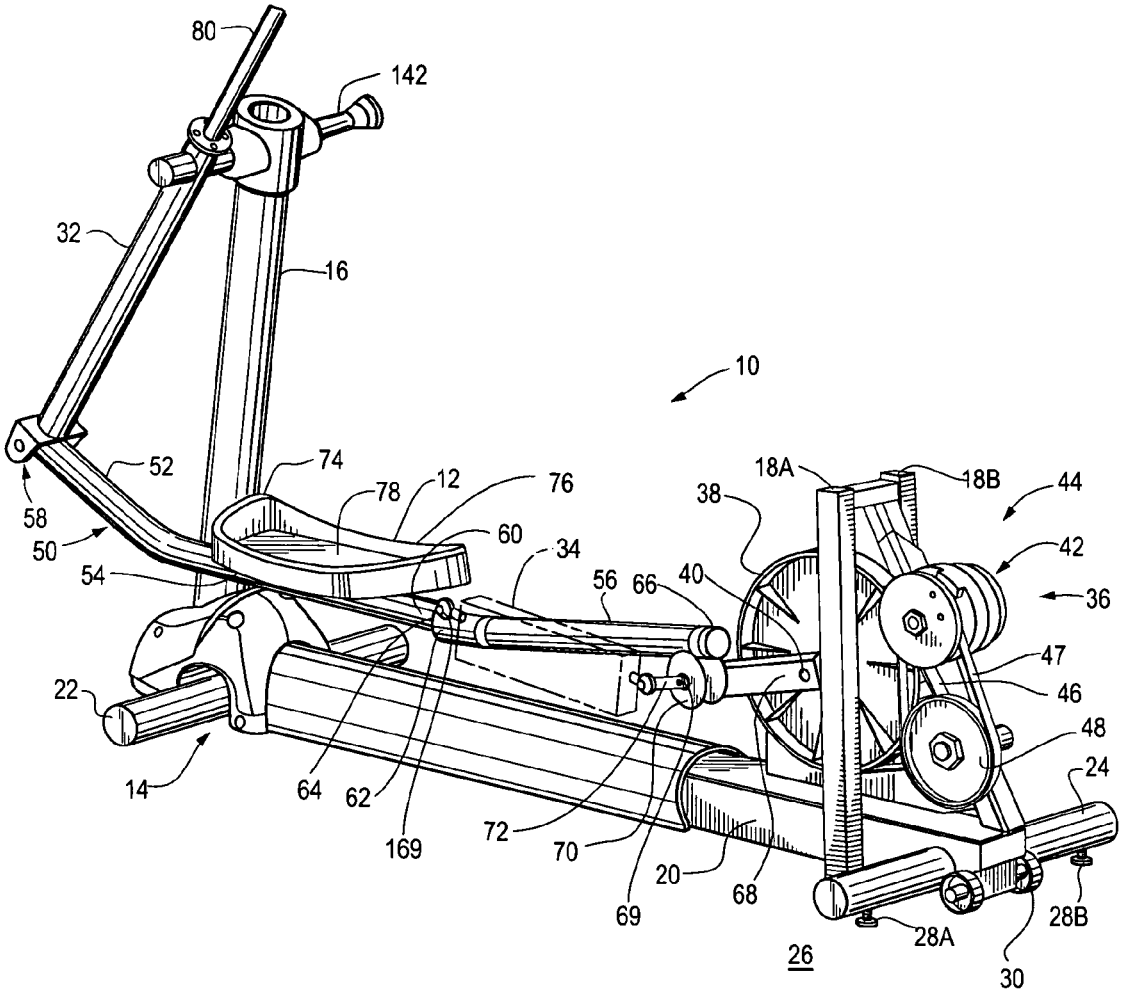
FIG. 1 is a side perspective view of an elliptical stepping exercise apparatus in which the method of the invention can be implemented.

FIG. 1 depicts, for the purpose of providing an environment for the invention, an example of an elliptical step exercise apparatus 10 that has the capability of adjusting the stride or the path of a foot pedal 12. The exercise apparatus 10 includes a frame, shown generally at 14. The frame 14 includes vertical support members 16, 18A and 18B which are secured to a longitudinal support member 20. The frame 14 further includes cross members 22 and 24 which are also secured to and bisect the longitudinal support member 20. The cross members 22 and 24 are configured for placement on a floor 26. A pair of levelers, 28A and 28B are secured to cross member 24 so that if the floor 26 is uneven, the cross member 24 can be raised or lowered such that the cross member 24, and the longitudinal support member 20 are substantially level. Additionally, a pair of wheels 30 are secured to the longitudinal support member 20 of the frame 14 at the rear of the exercise apparatus 10 so that the exercise apparatus 10 is easily moveable.

The exercise apparatus 10 further includes a rocker 32, an attachment assembly 34 and a motion controlling assembly 36. The motion controlling assembly 36 includes a pulley 38 supported by vertical support members 18A and 18B around a pivot axle 40. The motion controlling assembly 36 also includes resistive force and control components, including an alternator 42 and a speed increasing transmission 44 that includes the pulley 38. The alternator 42 provides a resistive torque that is transmitted to the pedal 12 and to the rocker 32 through the speed increasing transmission 44. The alternator 42 thus acts as a brake to apply a controllable resistive force to the movement of the pedal 12 and the movement of the rocker 32. Alternatively, a resistive force can be provided by any suitable component, for example, by an eddy current brake, a friction brake, a band brake or a hydraulic braking system. Specifically, the speed increasing transmission 44 includes the pulley 38 which is coupled by a first belt 46 to a second double pulley 48. The second double pulley 48 is then connected to the alternator 42 by a second belt 47. The speed increasing transmission 44 thereby transmits the resistive force provided by the alternator 42 to the pedal 12 and the rocker 32 via the pulley 38. A bent pedal lever 50 includes a first portion 52, a second portion 54 and a third portion 56. The first portion 52 of the pedal lever 50 has a forward end 58. The pedal 12 is secured to a top surface 60 of the second portion 54 of the pedal lever 50 by any suitable securing means. In this apparatus 10, the pedal 12 is secured such that the pedal 12 is substantially parallel to the second portion of the pedal lever 54. A bracket 62 is located at a rearward end 64 of the second portion 54. The third portion 56 of the pedal lever 50 has a rearward end 66. The bent pedal lever 50 allows a user to more easily mount the exercise apparatus 10.

The crank 68 is connected to and rotates about the pivot axle 40 and a roller axle 69 is secured to the other end of the crank 68 to rotatably mount the roller 70 so that it can rotate about the roller axle 69. The extension arm 72 is secured to the roller axle 69 making it an extension of the crank 68. The extension arm 72 is fixed with respect to the crank 68 and together they both rotate about the pivot axle 40. The rearward end of the attachment assembly 34 is pivotally connected to the end of the extension arm 72. The forward end of the attachment assembly 34 is pivotally connected to the bracket 62.

The pedal 12 of the exercise apparatus 10 includes a toe portion 74 and a heel portion 76 so that the heel portion 76 is intermediate to the toe portion 74 and the pivot axle 40. The pedal 12 of the exercise apparatus 10 also includes a top surface 78. The pedal 12 is secured to the top surface 60 of the pedal lever 50 in a manner so that the desired foot weight distribution and flexure are achieved when the pedal 12 travels in the substantially elliptical pathway as the rearward end 66 of the third portion 56 of the pedal lever 50 rolls on top of the roller 70, traveling in a rotationally arcuate pathway with respect to the pivot axle 40 and moves in an elliptical pathway around the pivot axle 40. Since the rearward end 66 of the pedal lever 50 is not maintained at a predetermined distance from the pivot axis 40 but instead follows the elliptical pathway, a more refined foot motion is achieved.

As a result of the bent pedal lever 50, the exercise apparatus 10 is easy for the user to mount. When the user then operates the pedal 12 in the previously described manner, the pedal 12 moves along the elliptical pathway in a manner that stimulates a natural heel to toe flexure that minimizes or eliminates stresses due to the unnatural foot flexures. If the user employs the moving upper handle 80, the exercise apparatus 10 exercises the user's upper body concurrently with the user's lower body thereby providing a total cross-training workout. The exercise apparatus 10 thus provides a wide variety of exercise programs that can be tailored to the specific needs and desires of individual users, and consequently, enhances exercise efficiency and promotes a pleasurable exercise experience.

Figure 2:
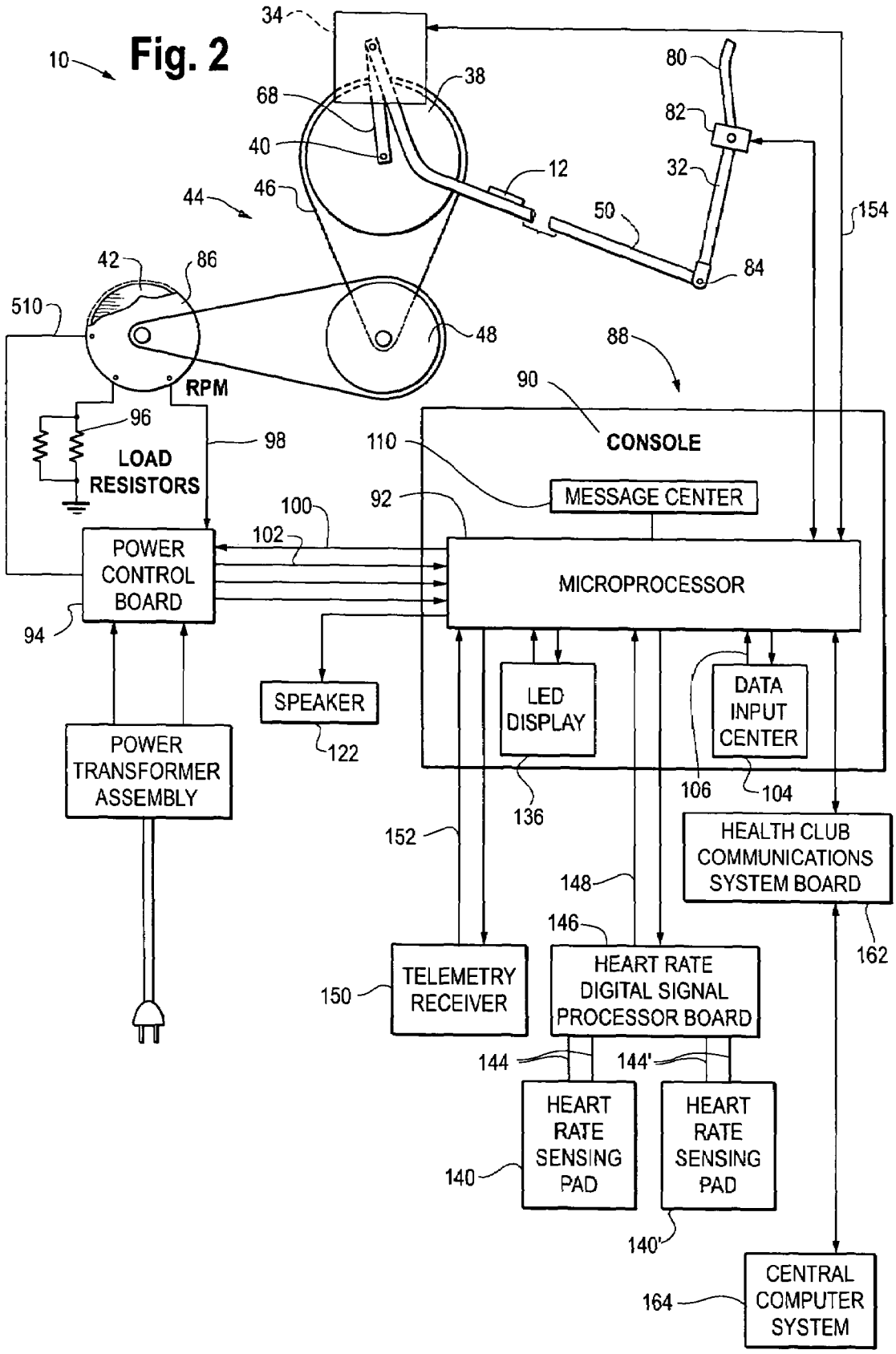
FIG. 2 is a schematic block diagram of representative mechanical and electrical components of an example of an elliptical stepping exercise apparatus of the type shown in FIG. 1.

FIG. 2 provides an environment for describing the invention and for simplicity shows in schematic form only one of two pedal mechanisms typically used in an elliptical stepping exercise apparatus of the type shown at 10. In particular, the exercise apparatus 10 described herein includes motion controlling components which operate in conjunction with an attachment assembly to provide an elliptical stepping exercise experience for the user. Included in this example of an elliptical stepping exercise apparatus 10 are the rocker 32, the pedal 12 secured to the pedal lever 50 and the pulley 38, supported by the vertical support members 18A and 18B, which is rotatable on the pivot axle 40. This embodiment 10 also includes the arm handle 80 connected to the rocker 32 at a pivot point 82 on the frame 14 of the apparatus 10. The crank 68 is pivotally connected to one end of the pedal lever 50 and rotates with the pulley 38 while the other end of the pedal lever 50 is pivotally attached to the rocker 32 at 58.

The apparatus 10 also includes resistive force and control components, including the alternator 42 and the speed increasing transmission 44 that includes the pulley 38. The alternator 42 provides a resistive torque that is transmitted to the pedal 12 and to the rocker 32 through the speed increasing transmission 44. The alternator 42 thus acts as a brake to apply a controllable resistive force to the movement of the pedal 12 and the movement of the rocker 32. Alternatively, a resistive force can be provided by any suitable component, for example, by an eddy current brake, a friction brake, a band brake or a hydraulic braking system. Specifically, the speed increasing transmission 44 includes the pulley 38 which is coupled by the first belt 46 to a second double pulley 48. The second belt 47 connects the second double pulley 48 to a flywheel 86 of the alternator 42. The speed increasing transmission 44 thereby transmits the resistive force provided by the alternator 42 to the pedal 12 and the rocker 32 via the pulley 38. Since the speed increasing transmission 44 causes the alternator 42 to rotate at a greater rate than the pivot axle 40, the alternator 42 can provide a more controlled resistance force. Preferably the speed increasing transmission 44 should increase the rate of rotation of the alternator 42 by a factor of 20 to 60 times the rate of rotation of the pivot axle 40 and in this embodiment the pulleys 38 and 48 are sized to provide a multiplication in speed by a factor of 40. Also, size of the transmission 44 is reduced by providing a two stage transmission using pulleys 38 and 48.

FIG. 2 provides illustrations of a control system 88 and a user input and display console 90 that can be used with elliptical exercise apparatus 10. In this particular embodiment of the control system 88, a microprocessor 92 is housed within the console 90 and is operatively connected to the alternator 42 via a power control board 94. The alternator 42 is also operatively connected to ground through a pair of load resistors 96. A pulse width modulated output signal on a line 98 from the power control board 94 is controlled by the microprocessor 92 and varies the current applied to the field of the alternator 42 by a predetermined field control signal on a line 100, in order to provide a resistive force which is transmitted to the pedal 12 and to the arm 80. When the user steps on the pedal 12, the motion of the pedal 12 is detected as a change in an RPM signal which represents pedal speed on a line 102. It should be noted that other types of speed sensors such as optical sensors can be used in machines of the type 10 to provide pedal speed signals. Thereafter, as explained in more detail below, the resistive force of the alternator 42 is varied by the microprocessor 92 in accordance with the specific exercise program selected by the user so that the user can operate the pedal 12 as previously described.

Figure 3:
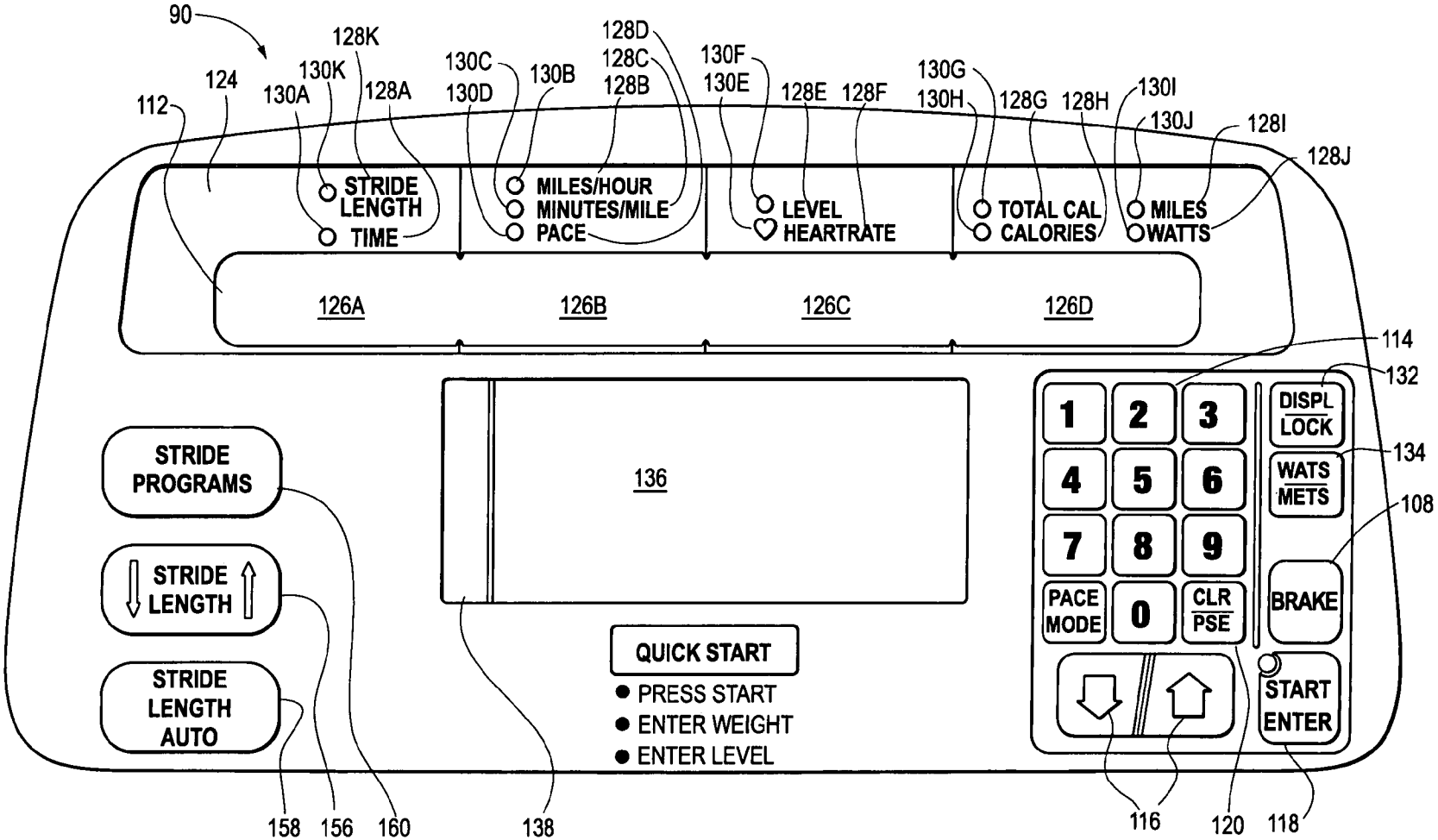
FIG. 3 is a plan layout of a display console for use with the elliptical exercise apparatus shown in FIG. 2.

The alternator 42 and the microprocessor 92 also interact to stop the motion of the pedal 12 when, for example, the user wants to terminate his exercise session on the apparatus 10. A data input center 104, which is operatively connected to the microprocessor 92 over a line 106, includes a brake key 108, as shown in FIG. 3, that can be employed by the user to stop the rotation of the pulley 38 and hence the motion of the pedal 12. When the user depresses the brake key 108, a stop signal is transmitted to the microprocessor 92 via an output signal on the line 106 of the data input center 104. Thereafter, the field control signal 100 of the microprocessor 92 is varied to increase the resistive load applied to the alternator 42. The output signal 98 of the alternator provides a measurement of the speed at which the pedal 12 is moving as a function of the revolutions per minute (RPM) of the alternator 42. A second output signal on the line 102 of the power control board 94 transmits the RPM signal to the microprocessor 92. The microprocessor 92 continues to apply a resistive load to the alternator 42 via the power control board 94 until the RPM equals a predetermined minimum which, in the preferred embodiment, is equal to or less than 5 RPM.

In this embodiment, the microprocessor 92 can also vary the resistive force of the alternator 42 in response to the user's input to provide different exercise levels. A message center 110 includes an alpha-numeric display screen 112, shown in FIG. 3, that displays messages to prompt the user in selecting one of several pre-programmed exercise levels. In the preferred embodiment, there are twenty-four pre-programmed exercise levels, with level one being the least difficult and level 24 the most difficult. The data input center 104 includes a numeric key pad 114 and a pair of selection arrows 116, shown in FIG. 3, either of which can be employed by the user to choose one of the pre-programmed exercise levels. For example, the user can select an exercise level by entering the number, corresponding to the exercise level, on the numeric keypad 114 and thereafter depressing a start/enter key 118. Alternatively, the user can select the desired exercise level by using the selection arrows 116 to change the level displayed on the alpha-numeric display screen 112 and thereafter depressing the start/enter key 118 when the desired exercise level is displayed. The data input center 104 also includes a clear/pause key 120, show in FIG. 3, which can be pressed by the user to clear or erase the data input before the start/enter key 118 is pressed. In addition, the exercise apparatus 10 includes a user-feedback apparatus that informs the user if the data entered are appropriate. In this embodiment, the user feed-back apparatus is a speaker 122, that is operatively connected to the microprocessor 92. The speaker 122 generates two sounds, one of which signals an improper selection and the second of which signals a proper selection. For example, if the user enters a number between 1 and 24 in response to the exercise level prompt displayed on the alpha-numeric screen 112, the speaker 122 generates the correct-input sound. On the other hand, if the user enters an incorrect datum, such as the number 100 for an exercise level, the speaker 122 generates the incorrect-input sound thereby informing the user that the data input was improper. The alpha-numeric display screen 112 also displays a message that informs the user that the data input was improper. Once the user selects the desired appropriate exercise level, the microprocessor 92 transmits a field control signal on the line 100 that sets the resistive load applied to the alternator 42 to a level corresponding with the pre-programmed exercise level chosen by the user.

The message center 110 displays various types of information while the user is exercising on the apparatus 10. As shown in FIG. 3, the alpha-numeric display panel 124 is divided into four sub-panels 126A-D, each of which is associated with specific types of information. Labels 128A-K and LED indicators 130A-K located above the sub-panels 126A-D indicate the type of information displayed in the sub-panels 126A-D. The first sub-panel 126A displays the time elapsed since the user began exercising on the exercise apparatus 10 as indicated by the label 128A and the LED indicator 130A or the stride length of the apparatus 10 as indicated by the label 128K and the LED indicator 130A. The second sub-panel 126B displays the pace at which the user is exercising. In the preferred embodiment, the pace can be displayed in miles per hour, minutes per mile or equivalent metric units as well as RPM. One of the LED indicators 130B-130D is illuminated to indicate in which of these units the pace is being displayed. The third sub-panel 126C displays either the exercise level chosen by the user or, as explained below, the heart rate of the user. The LED indicator 130F associated with the exercise level label 128E is illuminated when the level is displayed in the sub-panel 126C and the LED indicator 130E associated with the heart rate label 128F is illuminated when the sub-panel 126C displays the user's heart rate. The fourth sub-panel 126D displays four types of information: the calories per hour at which the user is currently exercising; the total calories that the user has actually expended during exercise; the distance, in miles or kilometers, that the user has "traveled" while exercising; and the power, in watts, that the user is currently generating. In the default mode of operation, the fourth sub-panel 126D scrolls among the four types of information. As each of the four types of information is displayed, the associated LED indicators 130G-J are individually illuminated, thereby identifying the information currently being displayed by the sub-panel 126D. A display lock key 132, located within the data input center 104, shown in FIG. 2, can be employed by the user to halt the scrolling display so that the sub-panel 126D continuously displays only one of the four information types. In addition, the user can lock the units of the power display in watts or in metabolic units ("mets"), or the user can change the units of the power display, to watts or mets or both, by depressing a watts/mets key 134 located within the data input center 104.

In the preferred embodiment of the invention, the exercise apparatus 10 also provides several pre-programmed exercise programs that are stored within and implemented by the microprocessor 92. The different exercise programs further promote an enjoyable exercise experience and enhance exercise efficiency. The alpha-numeric display screen 112 of the message center 110, together with a display panel 136, guide the user through the various exercise programs. Specifically, the alpha-numeric display screen 112 prompts the user to select among the various preprogrammed exercise programs and prompts the user to supply the data needed to implement the chosen exercise program. The display panel 136 displays a graphical image that represents the current exercise program. The simplest exercise program is a manual exercise program. In the manual exercise program the user simply chooses one of the twenty-four previously described exercise levels. In this case, the graphic image displayed by the display panel 136 is essentially flat and the different exercise levels are distinguished as vertically spaced-apart flat displays. A second exercise program, a so-called hill profile program, varies the effort required by the user in a pre-determined fashion which is designed to simulate movement along a series of hills. In implementing this program, the microprocessor 92 increases and decreases the resistive force of the alternator 42 thereby varying the amount of effort required by the user. The display panel 136 displays a series of vertical bars of varying heights that correspond to climbing up or down a series of hills. A portion 138 of the display panel 136 displays a single vertical bar whose height represents the user's current position on the displayed series of hills. A third exercise program, known as a random hill profile program, also varies the effort required by the user in a fashion which is designed to simulate movement along a series of hills. However, unlike the regular hill profile program, the random hill profile program provides a randomized sequence of hills so that the sequence varies from one exercise session to another. A detailed description of the random hill profile program and of the regular hill profile program can be found in U.S. Pat. No. 5,358,105, the entire disclosure of which is hereby incorporated by reference.

A fourth exercise program, known as a cross training program, urges the user to manipulate the pedal 12 in both the forward-stepping mode and the backward-stepping mode. When this program is selected by the user, the user begins moving the pedal 12 in one direction, for example, in the forward direction. After a predetermined period of time, the alpha-numeric display panel 136 prompts the user to prepare to reverse directions. Thereafter, the field control signal 100 from the microprocessor 92 is varied to effectively brake the motion of the pedal 12 and the arm 80. After the pedal 12 and the arm 80 stop, the alpha-numeric display screen 112 prompts the user to resume his workout. Thereafter, the user reverses directions and resumes his workout in the opposite direction.

Two exercise programs, a cardio program and a fat burning program, vary the resistive load of the alternator 42 as a function of the user's heart rate. When the cardio program is chosen, the microprocessor 92 varies the resistive load so that the user's heart rate is maintained at a value equivalent to 80% of a quantity equal to 220 minus the user's age. In the fat burning program, the resistive load is varied so that the user's heart rate is maintained at a value equivalent to 65% of a quantity equal to 220 minus the user's age. Consequently, when either of these programs is chosen, the alpha-numeric display screen 112 prompts the user to enter his age as one of the program parameters. Alternatively, the user can enter a desired heart rate. In addition, the exercise apparatus 10 includes a heart rate sensing device that measures the user's heart rate as he exercises. The heart rate sensing device consists of heart rate sensors 140 and 140' that can be mounted either on the moving arms 80 or a fixed handrail 142, as shown in FIG. 1. In the preferred embodiment, the sensors 140 and 140' are mounted on the moving arms 80. A set of output signals on a set of lines 144 and 144' corresponding to the user's heart rate is transmitted from the sensors 140 and 140' to a heart rate digital signal processing board 146. The processing board 146 then transmits a heart rate signal over a line 148 to the microprocessor 92. A detailed description of the sensors 140 and 140' and the heart rate digital signal processing board 146 can be found in U.S. Pat. Nos. 5,135,447 and 5,243,993, the entire disclosures of which are hereby incorporated by reference. In addition, the exercise apparatus 10 includes a telemetry receiver 150, shown in FIG. 2, that operates in an analogous fashion and transmits a telemetric heart rate signal over a line 152 to the microprocessor 92. The telemetry receiver 150 works in conjunction with a telemetry transmitter that is worn by the user. In the preferred embodiment, the telemetry transmitter is a telemetry strap worn by the user around the user's chest, although other types of transmitters are possible. Consequently, the exercise apparatus 10 can measure the user's heart rate through the telemetry receiver 150 if the user is not grasping the arm 80. Once the heart rate signal 148 or 152 is transmitted to the microprocessor 92, the resistive load 96 of the alternator 42 is varied to maintain the users heart rate at the calculated value.

In each of these exercise programs, the user provides data that determine the duration of the exercise program. The user can select between a number of exercise goal types including a time or a calories goal or, in the preferred embodiment of the invention, a distance goal. If the time goal type is chosen, the alpha-numeric display screen 112 prompts the user to enter the total time that he wants to exercise or, if the calories goal type is selected, the user enters the total number of calories that he wants to expend. Alternatively, the user can enter the total distance either in miles or kilometers. The microprocessor 92 then implements the selected exercise program for a period corresponding to the user's goal. If the user wants to stop exercising temporarily after the microprocessor 92 begins implementing the selected exercise program, depressing the clear/pause key 120 effectively brakes the pedal 12 and the arm 80 without erasing or changing any of the current program parameters. The user can then resume the selected exercise program by depressing the start/enter key 118. Alternatively, if the user wants to stop exercising altogether before the exercise program has been completed, the user simply depresses the brake key 108 to brake the pedal 12 and the arm 80. Thereafter, the user can resume exercising by depressing the start/enter key 118. In addition, the user can stop exercising by ceasing to move the pedal 12. The user then can resume exercising by again moving the pedal 12.

The exercise apparatus 10 also includes a pace option. In all but the cardio program and the fat burning program, the default mode is defined such that the pace option is on and the microprocessor 92 varies the resistive load of the alternator 42 as a function of the user's pace. When the pace option is on, the magnitude of the RPM signal 102 received by the microprocessor 92 determines the percentage of time during which the field control signal 100 is enabled and thereby the resistive force of the alternator 42. In general, the instantaneous velocity as represented by the RPM signal 102 is compared to a predetermined value to determine if the resistive force of the alternator 42 should be increased or decreased. In the presently preferred embodiment, the predetermined value is a constant of 30 RPM. Alternatively, the predetermined value could vary as a function of the exercise level chosen by the user. Thus, in the presently preferred embodiment, if the RPM signal 102 indicates that the instantaneous velocity of the pulley 38 is greater than 30 RPM, the percentage of time that the field control signal 100 is enabled is increased according to Equation 1.

$$\text{field control duty cycle} = \text{field control duty cycle} + \frac{((|\text{instantaneous } RPM - 30|)/2)^2 * \text{field control duty cycle})}{256} \quad \text{Equation 1}$$

where field duty cycle is a variable that represents the percentage of time that the field control signal 100 is enabled and where the instantaneous RPM represents the instantaneous value of the RPM signal 98.

On the other hand, in the presently preferred embodiment, if the RPM signal 102 indicates that the instantaneous velocity of the pulley 38 is less than 30 RPM, the percentage of time that the field control signal 100 is enabled is decreased according to Equation 2.

$$\text{field control duty cycle} = \text{field control duty cycle} - \frac{((|\text{instantaneous } RPM - 30|)/2)^2 * \text{field control duty cycle})}{256} \quad \text{Equation 2}$$

where field duty cycle is a variable that represents the percentage of time that the field control signal 100 is enabled and where the instantaneous RPM represents the instantaneous value of the RPM signal 102.

Moreover, once the user chooses an exercise level, the initial percentage of time that the field control signal 100 is enabled is pre-programmed as a function of the chosen exercise level as described in U.S. Pat. No. 6,099,439.

Manual and Automatic Stride Length Adjustment

In these embodiments of the invention, stride length can be varied automatically as a function of exercise or apparatus parameters. Specifically, the control system 88 and the console 90 of FIG. 2 can be used to control stride length in the elliptical step exercise apparatus 10 either manually or as a function of a user or operating parameter. In FIG. 1 the attachment assembly 34 generally represented within the dashed lines can be implemented by a number of mechanisms that provide for stride adjustment such as the stride length adjustment mechanisms depicted in FIGS. 4 through 10A-C. As shown in FIG. 2, a line 154 connects the microprocessor 92 to the electronically controlled actuator elements of the adjustment mechanisms in the attachment assembly 34. Stride length can then be varied by the user via a manual stride length key 156, shown in FIG. 3, which is connected to the microprocessor 92 via the data input center 104. Alternatively, the user can have stride length automatically varied by using a stride length auto key 158 that is also connected to the microprocessor 92 via the data input center 104. In one embodiment, the microprocessor 92 is programed to respond to the speed signal on line 102 to increase the stride length as the speed of the pedal 12 increases. Pedal direction, as indicated by the speed signal can also be used to vary stride length. For example, if the microprocessor 92 determines that the user is stepping backward on the pedal 12, the stride length can be reduced since an individual's stride is usually shorter when stepping backward. Additionally, the microprocessor 92 can be programmed to vary stride length as a function of other parameters such as resistive force generated by the alternator 42; heart rate measured by the senors 140 and 140'; and user data such as weight and height entered into the console 90.

Adjustable Stride Programs

Adjustable stride mechanisms make it possible to provide enhanced pre-programmed exercise programs of the type described above that are stored within and implemented by the microprocessor 92. As with the previously described exercise programs, the alpha-numeric display screen 112 of the message center 110, together with a display panel 136, can be used to guide the user through the various exercise programs. Specifically, the alpha-numeric display screen 112 prompts the user to select among the various preprogrammed exercise programs and prompts the user to supply the data needed to implement the selected exercise program. The display panel 136 also displays a graphical image that represents the current exercise program. For example, the graphic image displayed by the display panel 136 representing different exercise levels can include the series of vertical bars of varying heights that correspond to resistance levels that simulate climbing up or down a series of hills. In this embodiment, the portion 138 of the display panel 136 displays a single vertical bar whose height represents the user's current position on the displayed series of hills. Adjustable stride length programs can be selected by the user utilizing a stride program key 160, as shown in FIG. 3, which is connected to the microprocessor 92 via the data input center 104.

Operation of the Apparatus

The preferred embodiment of the exercise apparatus 10 further includes a communications board 162 that links the microprocessor 92 to a central computer 164, as shown in FIG. 2. Once the user has entered the preferred exercise program and associated parameters, the program and parameters can be saved in the central computer 164 via the communications board 162. Thus, during subsequent exercise sessions, the user can retrieve the saved program and parameters and can begin exercising without re-entering data. At the conclusion of an exercise program, the user's heart rate and total calories expended can be saved in the central computer 164 for future reference. Similarly, the central computer 164 can be used to save the total distance traveled along with the user's average miles per hour and minutes per mile pace during the exercise or these quantities can be tabulated to show the user's pace over the distance or time of the exercise. In addition, the communications board 162 can be used to compare distance traveled or pace for the purpose of comparison with other users on other step apparatus or even other types of exercise machines in real time in order, for example, to provide for simulated races between users.

In using the apparatus 10, the user begins his exercise session by first stepping on the pedal 12 which, as previously explained, is heavily damped due to the at-rest resistive force of the alternator 42. Once the user depresses the start/enter key 118, the alpha-numeric display screen 112 of the message center 110 prompts the user to enter the required information and to select among the various programs. First, the user is prompted to enter the user's weight. The alpha-numeric display screen 112, in conjunction with the display panel 136, then lists the exercise programs and prompts the user to select a program. Once a program is chosen, the alpha-numeric display screen 112 then prompts the user to provide program-specific information. For example, if the user has chosen the cardio program, the alpha-numeric display screen 112 prompts the user to enter the user's age. After the user has entered all the program-specific information such as age, weight and height, the user is prompted to specify the goal type (time or calories), to specify the desired exercise duration in either total time or total calories, and to choose one of the twenty-four exercise levels. Once the user has entered all the required parameters, the microprocessor 92 implements the selected exercise program based on the information provided by the user. When the user then operates the pedal 12 in the previously described manner, the pedal 12 moves along the elliptical pathway in a manner that simulates a natural heel to toe flexure that minimizes or eliminates stresses due to unnatural foot flexure. If the user employs the moving arm handle 80, the exercise apparatus 10 exercises the user's upper body concurrently with the user's lower body. The exercise apparatus 10 thus provides a wide variety of exercise programs that can be tailored to the specific needs and desires of individual users.

Stride Length Adjustment Mechanisms

The ability to adjust the stride length in an elliptical step exercise apparatus is desirable for a number of reasons. First, people, especially people with different physical characteristics such as height, tend to have different stride lengths when walking or running. Secondly, the length of an individual's stride generally increases as the individual increases his walking or running speed. As suggested in U.S. Pat. Nos. 5,743,834 and 6,027,431, there are a number of mechanisms for changing the geometry of an elliptical step mechanism in order to vary the path the foot follows in this type of apparatus.

FIGS. 4 through 10A-C depict a stride adjustment mechanism 166 which can be used to vary the stride length, i.e., maximum foot pedal displacement, without the need for an adjustable length crank. This mechanism 166 represents an embodiment of the attachment assembly 34 shown in FIGS. 1 and 2 that permits a user to vary stride length. Essentially, the stride adjustment mechanism 166 allows adjustment of stride length independent of the motion of the exercise apparatus 10 regardless of whether the exercise apparatus 10 is stationary, the user is pedaling forward, or pedaling in reverse. One of the major features of the stride adjustment mechanism 166 is that of a dynamic link, i.e., a linkage system that changes its length (distance between its two attachment points) cyclically during the motion of the apparatus 10. The stride adjustment mechanism 166 is pivotally attached to the pedal lever 50 by a link crank mechanism 168 at one end and pivotally attached to the crank extension 72 at the other end. The maximum pedal lever's 50 excursion, for a particular setting, is termed a stroke or stride. The stride adjustment mechanism 166 and the main crank 68 with the crank extension 72 together drive the maximum displacement or stroke of the pedal lever 50. By changing the dynamic phase angle relationship between the link crank 168 and the crank extension 72, it is possible to add to or subtract from the maximum displacement/stroke of the pedal lever 50. Therefore by varying the dynamic phase angle relationship between the link crank 168 and the crank extension 72, the stroke/stride of the pedal lever 50 varies the length of the major axis of the ellipse that the foot pedal 12 travels.

The preferred embodiment of the invention takes full advantage of the relative rotation between the crank extension 72 and a control link assembly 170 of the stride adjustment mechanism 166 as the user moves the pedals 12. In this embodiment, the stride adjustment mechanism 166 includes the control link assembly 170 and two secondary crank arms, the link crank assembly 168 and the crank extension 72. The control link assembly 170 includes a pair of driven timing-pulley shafts 172 and 174, a pair of toothed timing-pulleys 176 and 178 and a toothed timing-belt 180 engaged with the timing pulleys 176 and 178. For clarity, the timing belt is not shown in FIG. 4 but is shown in FIG. 5. Also included in the link crank assembly 168 is a link crank actuator 182. One end of the crank-extension 72 is rigidly attached to the main crank 68. The other end of the crank-extension 72 is rigidly attached to the rear driven timing-pulley shaft 174 and the pulley 178. Also, the rear driven timing-pulley shaft 174 is rotationally attached to the rearward end of the control link assembly 170. The forward end of the control link assembly 170 is rotationally attached to the forward driven timing-pulley shaft 172 and pulley 176. The two timing-pulleys 176 and 178 are connected to each other via the timing-belt 180. The forward driven timing-pulley shaft 172 is pivotally attached to the link crank 168, but held in a fixed position by the link crank actuator 182, i.e., when the actuator 182 is stationary, the link crank 168 behaves as if it were rigidly attached to the forward driven timing-pulley shaft 172. The other end of the link crank 168 is pivotally attached to the pedal lever 50. In this particular embodiment of the elliptical step apparatus 10 shown in FIGS. 4 and 5, the main crank arm 68 via a revolute joint on a linear slot supports the rearward end of the pedal lever 50. Here, this takes the form of a roller and track interface indicated generally at 184. When the apparatus 10 is put in motion, there is relative rotation between the crank extension/rearward timing-pulley 178 and the control link 170. This timing-pulley rotation drives the forward driven timing-pulley 176 via the timing-belt 180. Since the forward driven timing-pulley 176 is rigidly attached to one end of the link crank 168, the link crank 168 rotates relative to the pedal lever 50. Because the control link 170 is a rigid body, the rotation of the link crank 168 moves the pedal lever 50 in a prescribed motion on its support system 184. In order to facilitate installation, removal and tension adjustment of the belt 180 on the pulleys 176 and 178, the control link 170 includes a turnbuckle 186 that can be used to selectively shorten or lengthen the distance between the pulleys 176 and 178.

Figure 4:
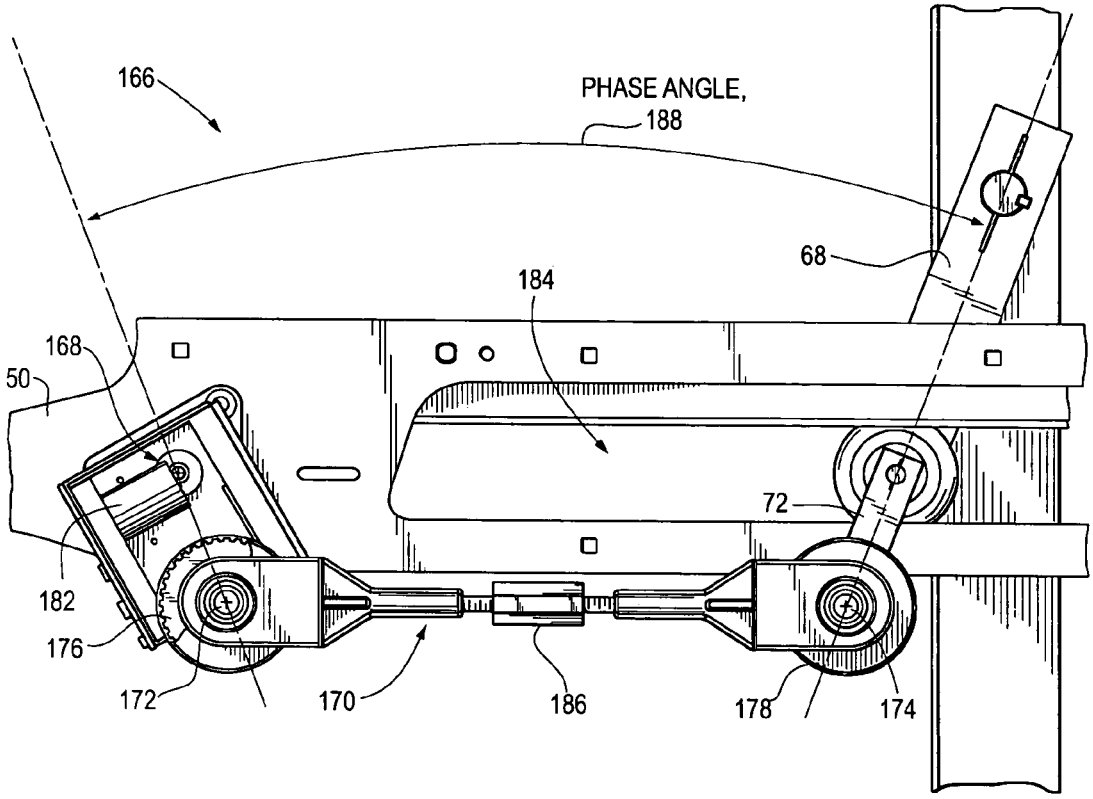
FIGS. 4 and 5 are views of a mechanism for adjusting stride length in an elliptical stepping apparatus of the type shown in FIG. 1.
Figure 5:
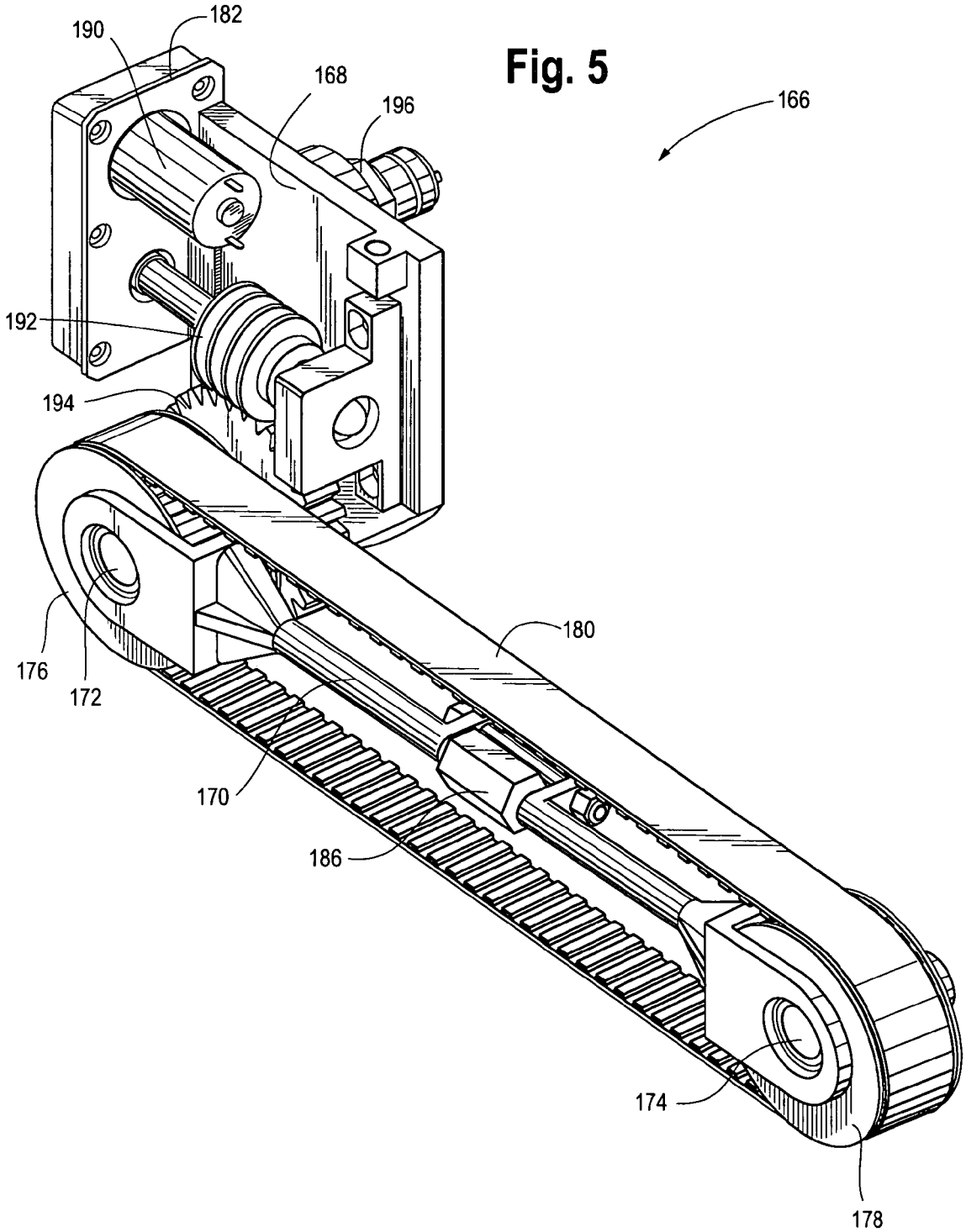

In this mechanism 166, there exists a relative angle indicated by an arrow 188 shown in FIG. 4 between the link crank 168 and the crank extension 72. This relative angle 188 will be referred to as the LC-CE phase angle. When the link crank actuator 182 is stationary, the LC-CE phase angle 188 remains constant, even if the apparatus 10 is in motion. When the actuator 182 is activated, the LC-CE phase angle 188 changes independent of the motion of the apparatus 10. Varying the LC-CE phase angle 188 effects a change in the motion of the machine 10, in this case, changing the stride length.

In this embodiment, shown in FIG. 5, the link crank actuator 182 includes a gear-motor (integrated motor and gearbox) 190, a worm/worm shaft 192, and a worm gear 194. Because the link crank actuator 190 rotates about an axis relative to the pedal lever 50, a conventional slip-ring type device 196 is preferably used to supply electrical power, from for example the power control board 94 shown in FIG. 2, across this rotary interface to the DC motor of the gear-motor 190. When power is applied to the gear-motor 190, the worm shaft 192 and the worm gear 194 rotate. The rotating worm shaft 192 rotates the worm gear 194, which is rigidly connected to the driven timing pulley 176. In addition, the worm gear 194 and the forward pulley 176 rotate relative to the link crank 168 to effect the LC-CE phase angle 188 change between the crank extension 72 and the link crank 168. A reverse phase angle change occurs when the motor 190 is reversed causing a reverse stride change, i.e., increase or decrease stride length. In this embodiment, less than half of the 360 degrees of the possible phase angle relationship between the link crank 168 and the crank extension 72 is used. In some mechanisms using more or the full range of possible phase angles may provide different and desirable ellipse shapes.

The schematics of FIGS. 6A-D, 7A-D and 8A-D illustrate the effect of the phase angle change between the crank extension 72 and the link crank 168 for a 180 degree, a 60 degree and a 0 degree phase relationship respectively. In FIGS. 6A-D the elliptical path 198 represents the path of the pedal 12 for the longest stride; in FIGS. 7A-D the elliptical path 198' represents the path of the pedal 12 for an intermediate stride; and in FIGS. 8A-D the elliptical path 198" represents the path of the pedal 12 for the shortest stride.

In certain circumstances, characteristics of stride adjustment mechanism 166 can result in some undesirable effects. Therefore it can be desirable to implement various modifications to reduce the effects of these phenomena. For example, when the stride adjustment mechanism 166 is adjusted to the maximum stroke/stride setting, the LC-CE phase angle is 180 degrees. At this 180-degree LC-CE phase angle setting, the components of the stride adjustment mechanism 166 will pass through a collinear or toggle condition. This collinear condition occurs at or near the maximum forward excursion of the pedal lever 50, which is at or near a maximum acceleration magnitude of the pedal lever 50. At slow pedal speeds, the horizontal acceleration forces are relatively low. As pedal lever speeds increase, effects of the condition increase in magnitude proportional to the change in speed. Eventually, this condition can produce soft jerk instead of a smooth transition from forward motion to rearward motion. To overcome this potential problem several approaches can be taken including: limiting the maximum LC-CE phase angle 188 to less than 180 degrees, e.g., restricting stride range to 95% of mechanical maximum; changing the prescribed path shape 198 of the foot pedal 12; and reducing the mass of the moving components in the stride adjustment mechanism 166 and the pedal lever 50 to reduce the acceleration forces.

Another problem can occur when the stride adjustment mechanism 166 is in motion and where the tension side of the timing-belt 180 alternates between the top portion and the lower portion. This can be described as the tension in the belt 180 changing cyclically during the motion of the mechanism 166. At slow speeds, the effect of the cyclic belt tension magnitude is relatively low. At higher speeds, this condition can produce a soft "bump" perception in the motion of the apparatus 10 as the belt 180 quickly tenses and quickly relaxes cyclically. Approaches to dealing with this belt tension problem can include: increasing the timing-belt tension using for example the turnbuckle 186 until the "bump" perception is dampened; increasing the stiffness of the belt 180; increasing the bending stiffness of the control link assembly 170; and installing an active tensioner device for the belt 180.

A further problem can occur when the stride adjustment mechanism 166 is in motion where a vertical force acts on the pedal lever 50. The magnitude of this force changes cyclically during the motion of the mechanism 166. At long strides and relatively high pedal speeds, this force can be sufficient to cause the pedal lever 50 to momentarily lift off its rearward support roller 70. This potential problem can be addressed in a number of ways including: installing a restrained rearward support, e.g., a linear bearing and shaft system, linear guides rail system, roller-trammel system 184, as shown in FIG. 4, etc.; limiting the maximum LC-CE phase angle 188 to less than 180 degrees; e.g., restricting stride range to 95% of mechanical maximum; and reducing the mass of the moving components in the stride adjustment mechanism and the pedal levers.

Adjustable Stride Length Control

With reference to the control system 88 shown in FIG. 2, a mechanism is described whereby stride length can be controlled by the user or automatically modified in the type of exercise apparatus 10 shown in FIG. 1 to take into account the characteristics of the user or the exercise being performed. Specifically, the control system 88 and the console 90 of FIG. 3 can be used to control stride length in the elliptical step exercise apparatus 10 either manually or as a function of a user or operating parameter. In FIG. 1 the attachment assembly can be implemented by a number of mechanisms that provide for stride adjustment such as the stride adjustment mechanism 166 described above. As shown in FIG. 2, a line 154 connects the microprocessor 92 to the attachment assembly 34 which in the case of the stride adjustment mechanism 166 would be the DC motor 190 as shown in FIG. 5. Stride length can then be varied by the user via a manual stride length key 156 which is connected to the microprocessor 92 via the data input center 104. Alternatively, the user can have stride length automatically varied by using a stride length auto key that is also connected to the microprocessor 92 via the data input center 104. In one embodiment, the microprocessor is programed to respond to the speed signal on line 102 to increase the stride length as the speed of the pedals 12 increases. Pedal direction, as indicated by the speed signal can also be used to vary stride length. For example, if the microprocessor 92 determines that the user is stepping backward on the pedals 12, the stride length can be reduced since an individual's stride is usually shorter when stepping backward. Additionally, the microprocessor 92 can be programmed to vary stride length as a function of other parameters such as resistive force generated by the alternator 42; heart rate measured by the senors 140 and 140'; and user data such as weight and height entered into the console 90.

Another important aspect of the adjustable stride length control is a feedback mechanism to provide the processor 92 with information regarding the stride length of the apparatus 10. The measurement of stride length on an elliptical step apparatus can be important for a number of reasons including insuring that both pedal mechanisms have the same stride length. In the context of the apparatus 10 shown in FIG. 1 stride length information can be transmitted over the line 154 from the attachment assembly 34 to the processor 92.

Figure 6A:
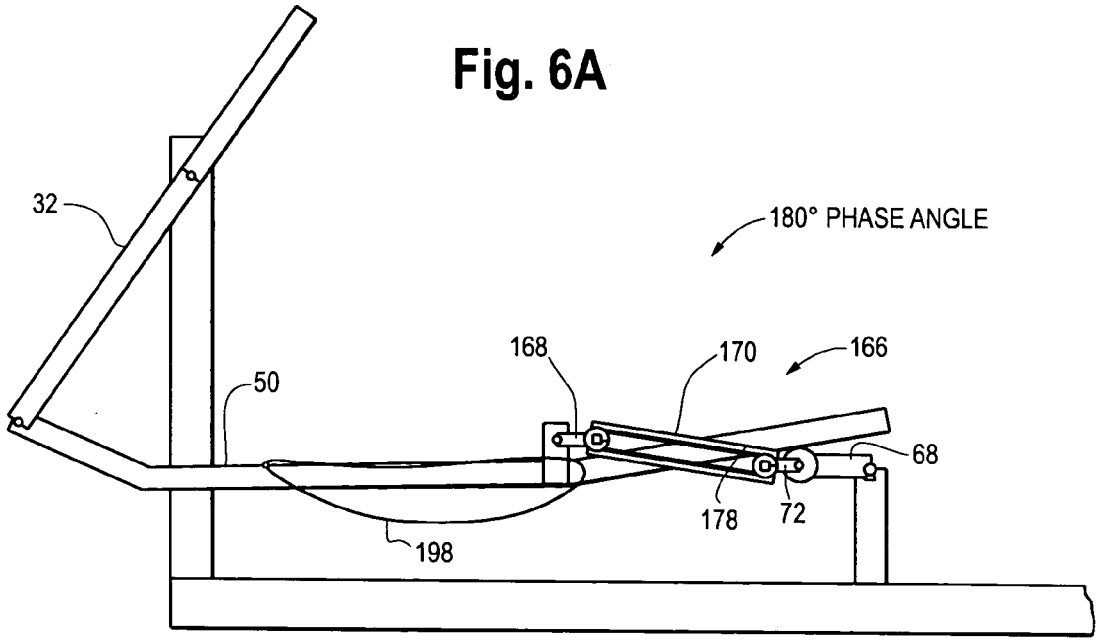
FIGS. 6A, 6B, 6C and 6D are schematic diagrams illustrating the operation of the mechanism of FIGS. 4 and 5 for a 180 degree phase angle.
Figure 6B:
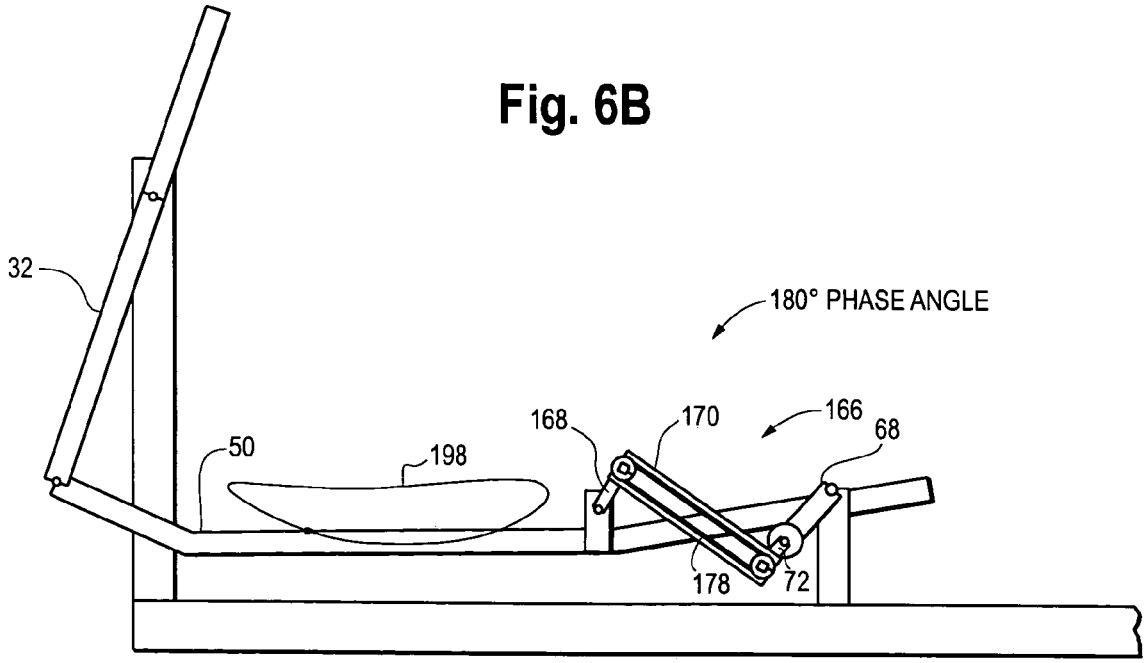
Figure 6C:
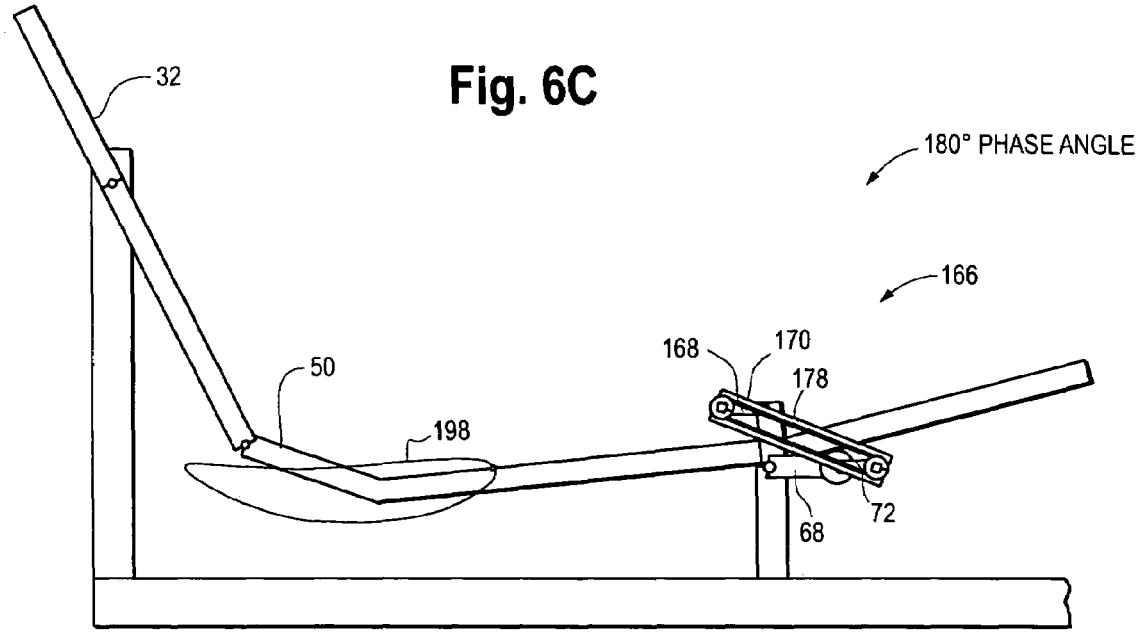
Figure 6D:
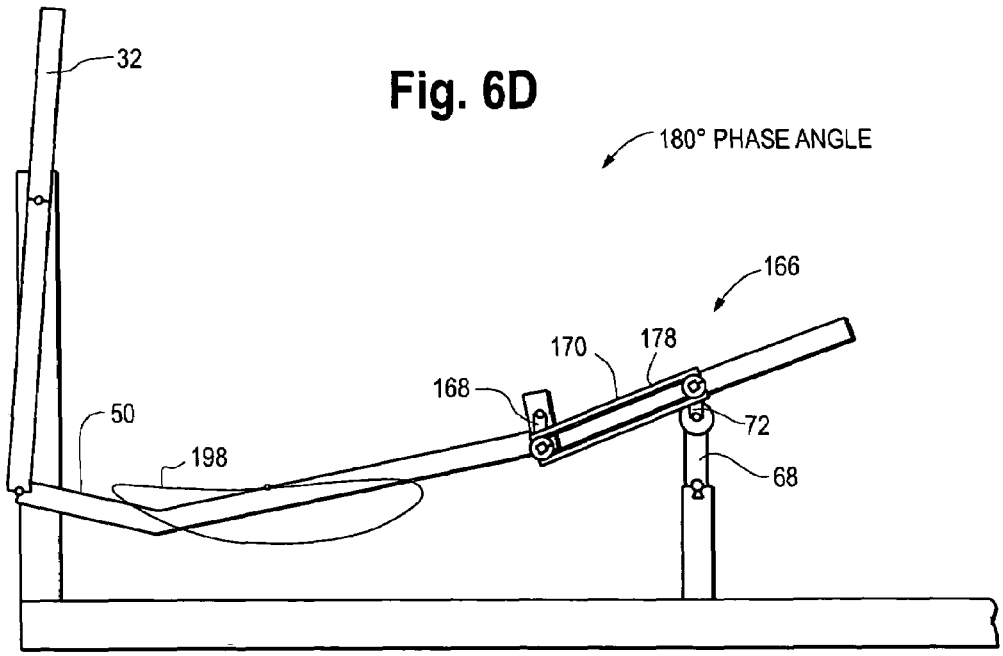
Figure 7A:
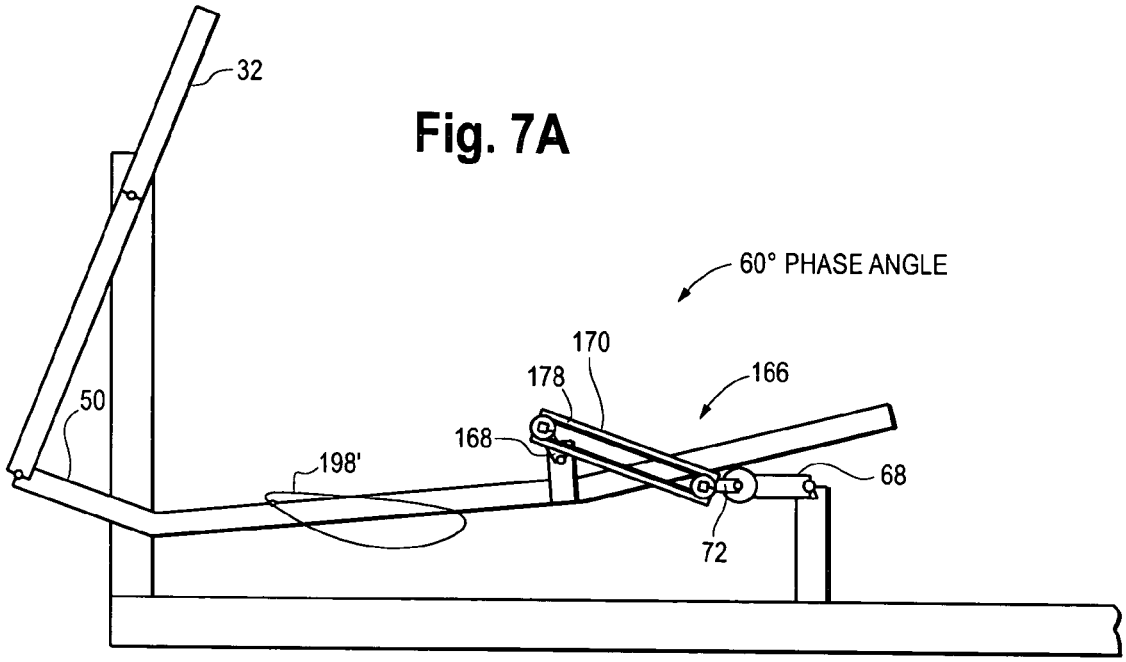
FIGS. 7A, 7B, 7C and 7D are schematic diagrams illustrating the operation of the dynamic link mechanism of FIGS. 4-5 for a 60 degree phase angle.
Figure 7B:
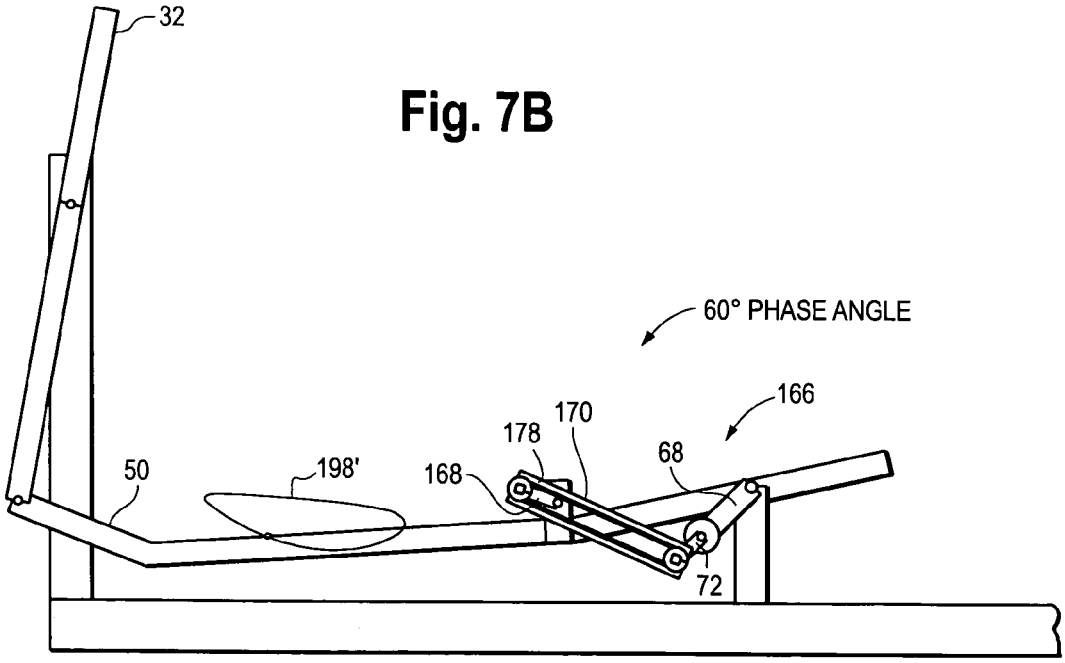
Figure 7C:
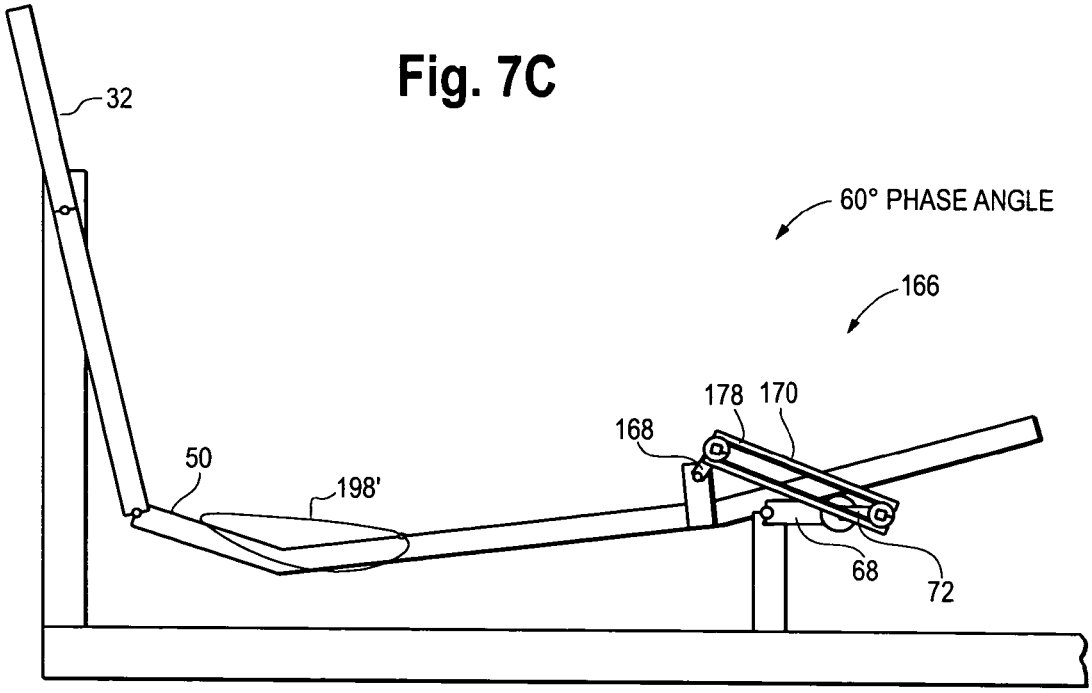
Figure 7D:
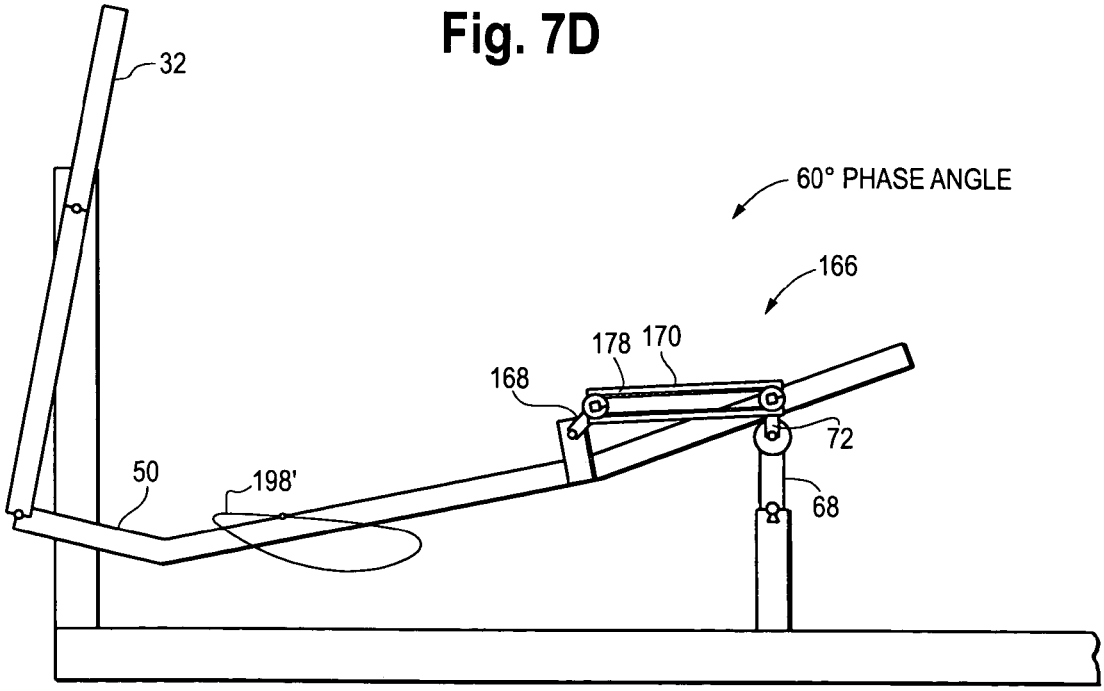
Figure 8A:
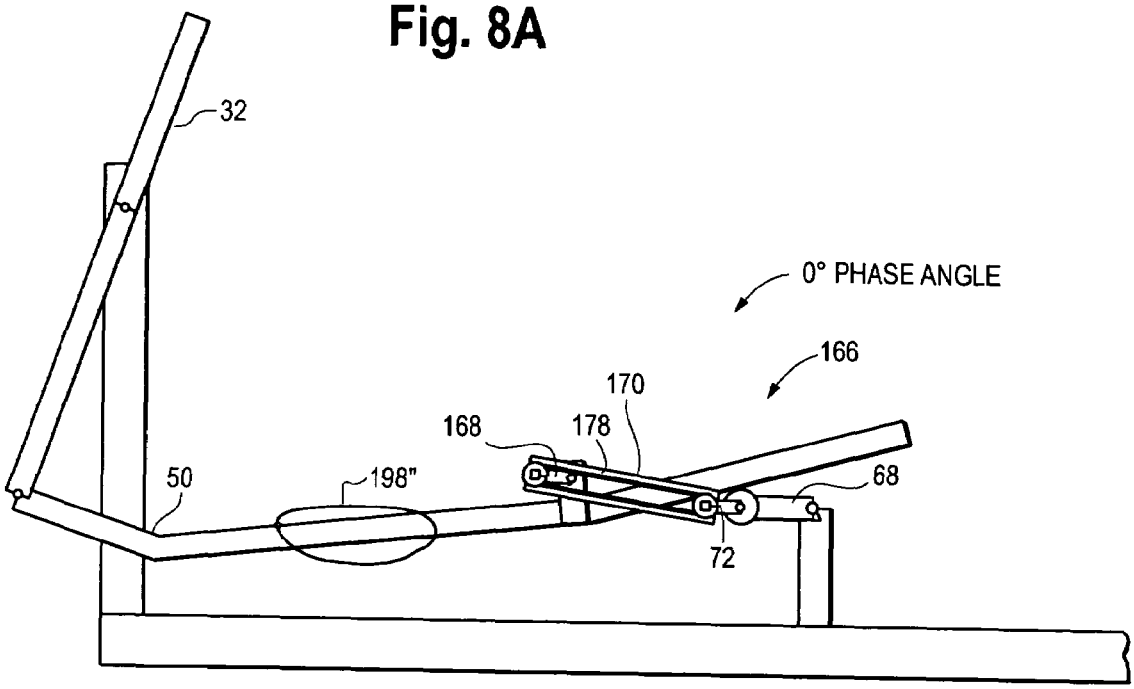
FIGS. 8A, 8B, 8C and 8D are schematic diagrams illustrating the operation of the dynamic link mechanism of FIGS. 4 and 5 for a zero degree phase angle.
Figure 8B:
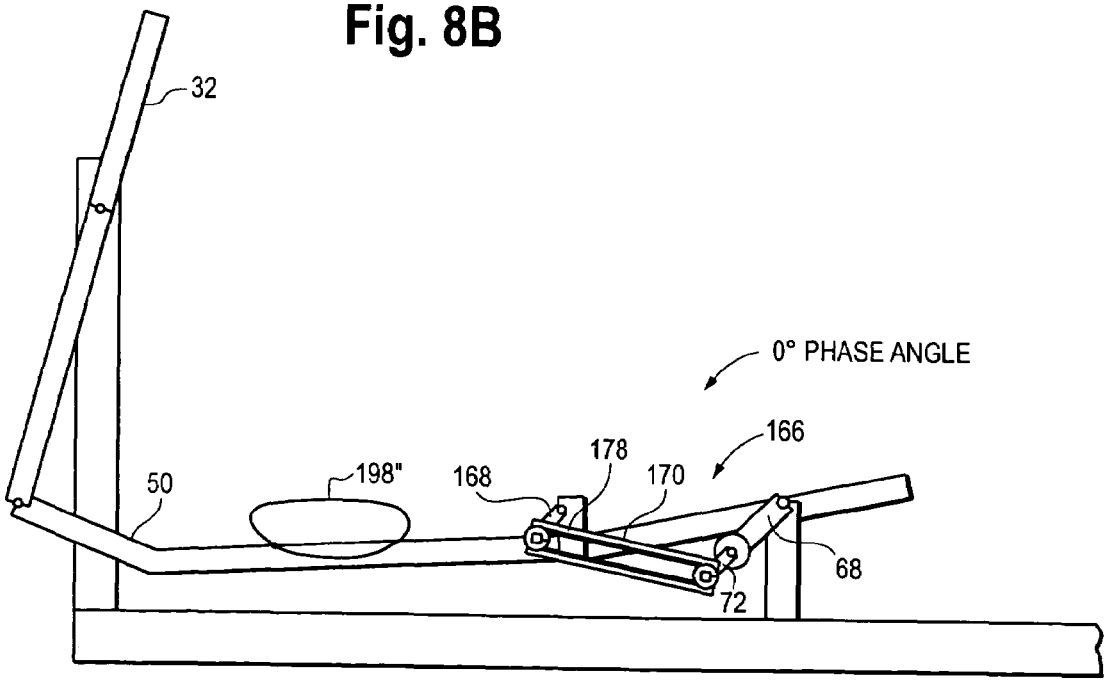
Figure 8C:
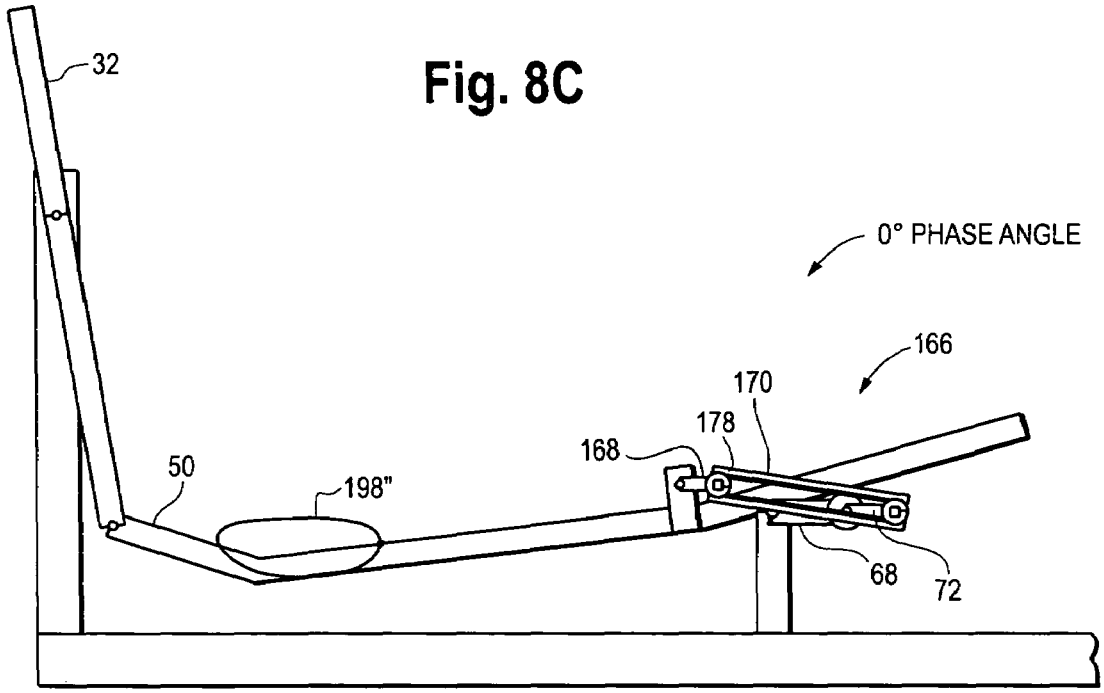
Figure 8D:
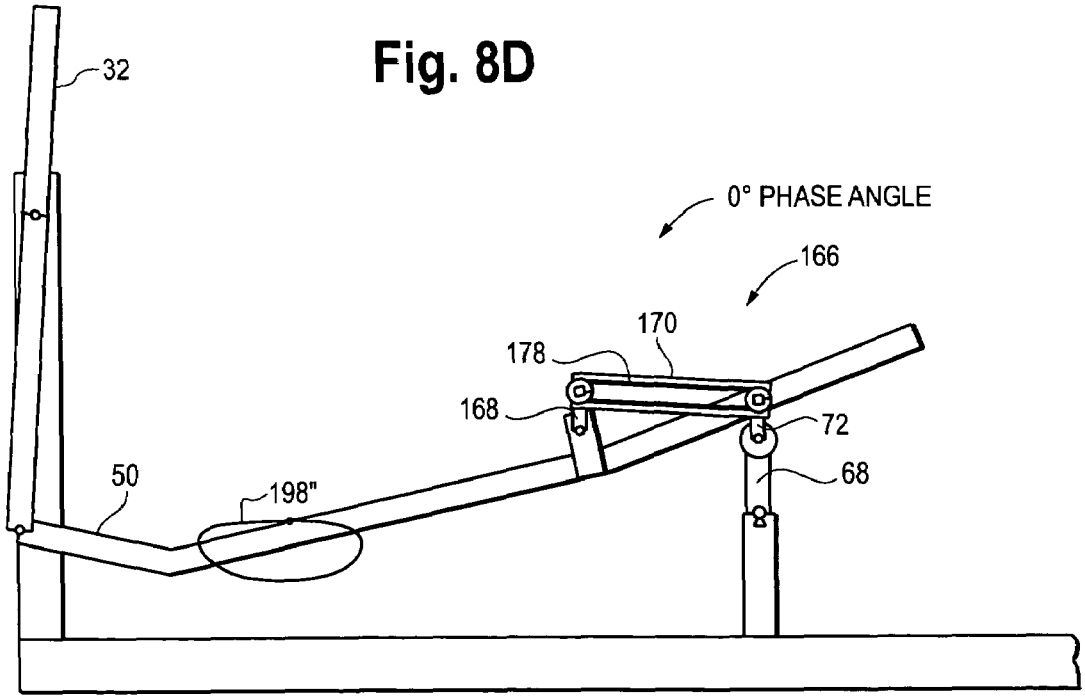

There are a number of methods of acquiring stride length information the utility of which can be dependent on the mechanical arrangement of the elliptical step apparatus including the mechanism for adjusting stride length. One method for obtaining this information from an apparatus employing the stride adjustment mechanism 166 involves the use of the phase angle 188 as shown in FIG. 4. Referring to FIGS. 1 and 6A, the angular relation between the crank extension 72 and each of the link cranks 168 is proportional to the stride length. A sensor system such as reed switches and magnets can be mounted to each of the cranks 68 and feedback from each, along with the speed signal on the line 98 from the alternator 42, can be used by the processor 92 to calculate stride length of each pedal 12.

Figure 9:
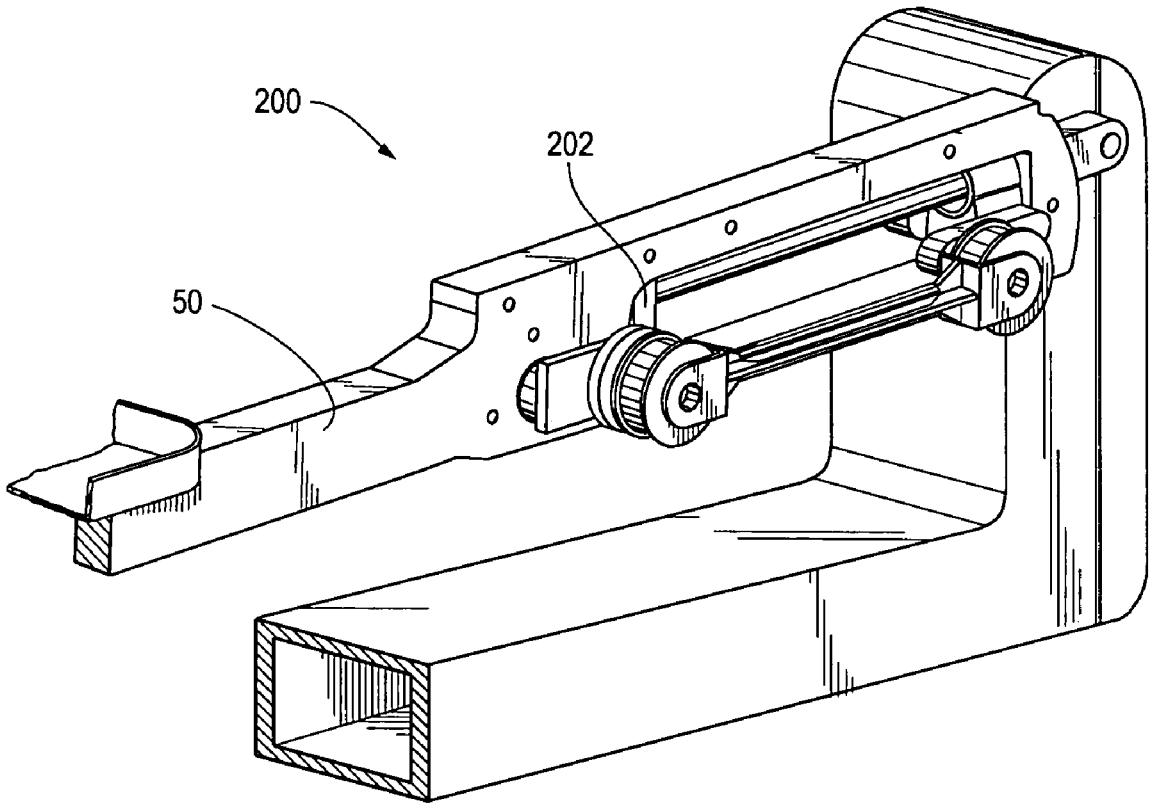
FIG. 9 is a side perspective view of a linear guide assembly for use with the mechanisms of FIGS. 4 and 5.

With reference to FIG. 9, a second method involves using a linear encoder. This method uses the relative motion between the pedal lever 50 and a linear guide assembly 200 that replaces the roller 70 shown in FIG. 4. The linear guide 200 supports the pedal lever 50 during its travel. The distance that the linear guide 200 travels along the pedal lever 50 can be related to the stride length. An encoder 202 would reside on the pedal lever 50 and the movable mechanism for the encoder will be connected to the linear guide assembly 200. A sensor system can be placed on the pedal lever 50 and used as an index position. Then, for example, if 3 index pulses are generated, the crank 68 will have traveled one complete revolution. The distance traveled by the linear guide 200 can then be determined by adding the encoder pulses for every 3 index pulses and looking this up in a table that would be created for this purpose. In this manner the stride length feedback signal can be provided to the processor 92.

Figure 10A:
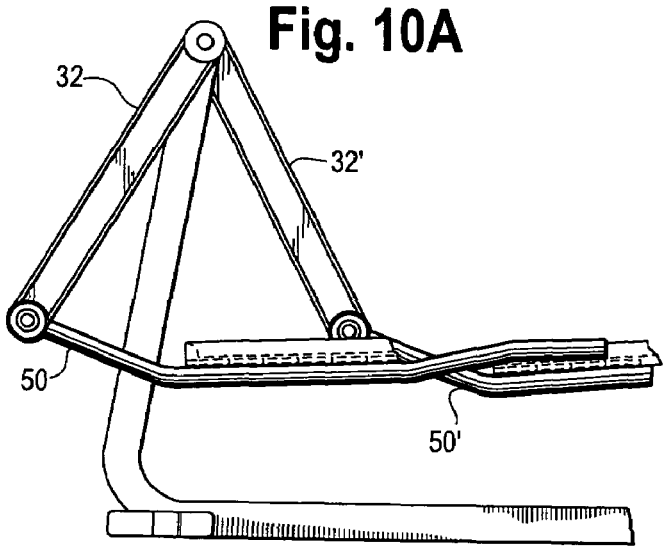
FIGS. 10A, 10B and 10C are a set of schematic diagrams illustrating angle measurements that can be used to determine stride length in an elliptical stepping apparatus of the type shown in FIGS. 1, 4 and 5.
Figure 10B:
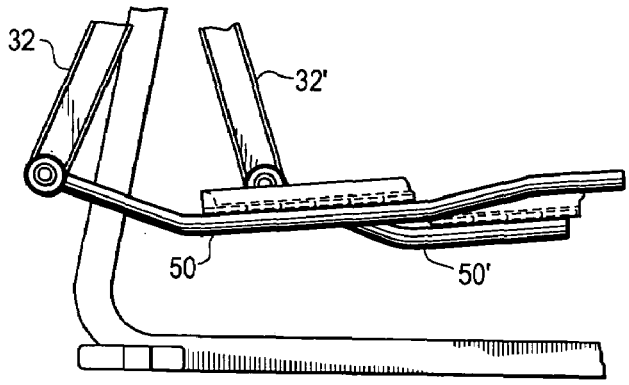
Figure 10C:
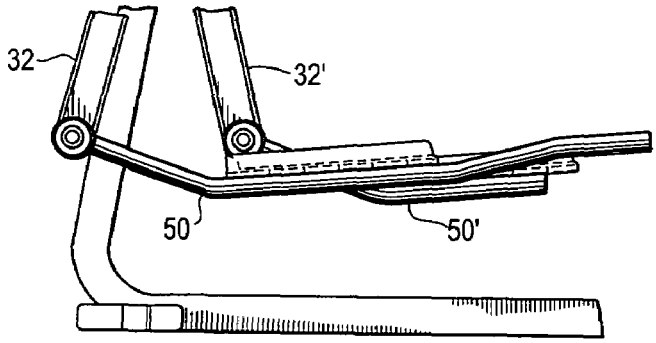

FIGS. 10A-C provide an illustration of a third method of determining stride length. This method measures the maximum and minimum angle between the rocker arms 32 and 32' and pedal levers 50 and 50' respectively for various stride lengths. These angles, as shown in FIGS. 10A-C can then be used to determine the stride length of the pedal 12 from this angular information. Commercially available shaft angle encoders can be mounted at the pivot points between the pedal levers 50 and 50' and the rocker arms 32 and 32'.

A fourth method of determining stride length can make use of the speed of the pedal lever 50. This method measures the speed of the pedal 12 using the tachometer signal on line 98 through a fastest point of travel on the elliptical path 198 which changes with stride length. The pedal speed at the bottom most point of travel on the ellipse will increase as stride length increases. For example, the speed of the pedal 12 can be measured by placing 2 magnets on the pedal 12 twelve inches apart such that the two magnets will cross a certain point in space close to the bottom most point of pedal travel. A sensor can then be placed at that point in space (in the middle of the unit) such that each magnet will trigger the sensor. The number of AC Tap pulses on line 98 for example received between the two sensor activation signals can be measured and thus the stride length calculated. A Hall effect sensor can be used as the sensor.

Distance Measurement

In the preferred embodiment of the invention, the specific needs of users can be enhanced by providing the user with a measure of the distance and the rate of distance traveled on an elliptical step exercise type apparatus and displaying it as described above. However, as previously indicated, there is no direct correlation between the user's foot motion and distance covered as there is in a treadmill or a stationary bicycle. One approach is to approximate the distance over the ground covered by a user that would result from the elliptical foot motion generated by an apparatus such as the elliptical step apparatus 10 depicted in FIG. 1. According to the preferred method for measuring distance, first the biomechanics of walking and running are considered. Since the foot motion on an elliptical step apparatus, such as the foot path 198 on the elliptical apparatus 10 as shown in FIGS. 6A-6D, is generally similar to the foot motion of an individual walking or running on a treadmill, comparison of foot motion to distance traveled on a treadmill provides a good analog to an elliptical apparatus. From a biomechanical standpoint, it is apparent that the distance traveled while walking or running on a treadmill is a function of the contact length between the foot and the treadmill belt. As the belt speed increases and the user progresses from a walk to a jog to a run, the contact length varies and the distance traveled increases relative to the contact distance. This is due to increased leg extension at a fast walk and the push-off to the airborne period during jogging and running. For example, Table 1 below provides representative data indicating that distance traveled increases relative to contact distance and distance traveled as a function of increasing speeds on a treadmill as represented by a distance multiplier.

TABLE 1

| Treadmill Speed | Contact Distance (inches) | Distance Traveled (inches) | Distance Multiplier |
|---|---|---|---|
| 2.5 mph - slow walk | 27.6 | 26.4 | 1.00 |
| 4.0 mph - fast walk | 32.1 | 35.2 | 1.10 |
| 5.0 mph - jog | 21.4 | 35.7 | 1.67 |
| 7.0 mph - run | 22.5 | 47.4 | 2.11 |

Next, according to the preferred method of the invention, it is desirable to provide a measure that correlates to the contact distance on a treadmill in order to measure distance traveled on an elliptical apparatus. In this case, the portion of the path 198 that the foot pedals take upon which the user applies force with his foot is considered to be equivalent to the foot contact distance on a treadmill. For purposes of this description, the term "contact distance" will also be used in connection with the calculation of the distance traveled on an elliptical exercise apparatus.

Figure 11:
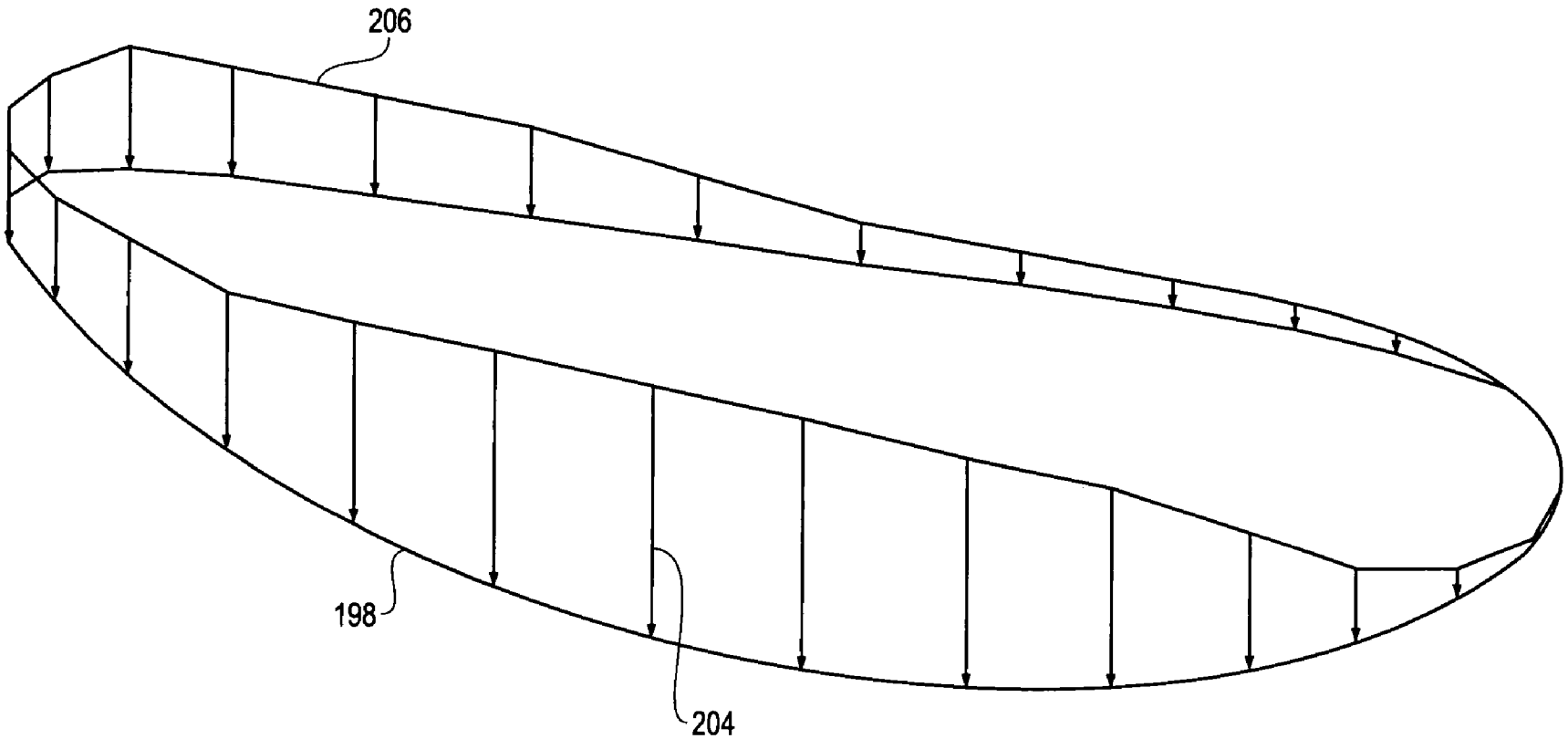
FIG. 11 is a graphical representation of the pedal motion of an elliptical stepping exercise apparatus of the type shown in FIG. 1.

FIG. 11 provides an illustration of the elliptical path 198 which the pedal 12 of the apparatus 10 of FIG. 1 takes as the pulley 38 rotates. To measure contact distance on the pedal 12, a force measuring apparatus such as a strain gauge can be inserted between the user's foot and the pedal 12. The forces generated by the user's foot on the pedal 12 can then be measured as the pedal 12 rotates about the path 198. A set of vertical force vector lines represented by a line 204 in FIG. 11 represents an example of one such measurement. Another line 206 effectively depicts the portion of the perimeter of the path 198 upon which significant contact force is applied by the user to the foot pedal 12. In this case, approximately 75% of the perimeter of the path 198 receives significant contact force from the user's foot. Thus, for example, if the perimeter of the path 198 is 39 inches, the contact distance will be about 29 inches. In the preferred embodiment of the invention, it is desirable to measure the contact force for different users at different speeds of the pedal 12 in order to provide a representative average for contact length. It has been found that between 60% and 80% of the perimeter of the path 198 can, depending on the mechanical arrangement of the apparatus 10 and the speed of the pedal 12, serve as contact lengths suitable for measuring distance traveled. In any case, it is desirable that over 50% of the perimeter of the path 198 be used as a contact length.

Contact length (CL) in miles for an exercise over a time period then can be calculated by:

$$CL=(CD\times 2\times \mathrm{RPM}\times t)/K$$

where CD is the contact distance in inches, 2 is a constant to take into account both the user's right and left foot, RPM is the speed of the pulley 38 that corresponds to the rotational speed of the pedal 12, t is time in minutes and K is a constant, in this case 63,360, that converts the calculation from inches to miles.

It is then desirable to modify this calculation for speed to take into account the variation in contact distance with speed due to the variations in stride as discussed above. Preferably, a multiplier corresponding at least in concept to the multiplier set forth in table 1 above should be used. Because the ellipse 198 is fixed by the mechanics of the elliptical step apparatus 10 and the contact length does not have much opportunity to vary, the multiplier is reduced for higher RPMs in this embodiment of the invention. This can be done by making the multiplier nonlinear for greater speeds. In addition, comparisons of perceived exertions between treadmills and elliptical step apparatuses can be used to derive a regression for the multiplier versus the elliptical step apparatus. For example, by using similar perceived exertions between workouts on a treadmill and elliptical step apparatus, such as average heart rate and time, a known distance obtained from the treadmill can be correlated to the elliptical step apparatus to derive a multiplier. As a result, the preferred multiplier has a substantially linear relationship with RPM for lower and medium pedal speeds and a decreasing rate of increase for the higher pedal speeds. The general form of this multiplier (M) can be represented by:

$$M=(a\times\mathrm{RPM})\times(-b\times\mathrm{RPM}^2)+(c)$$

where the coefficients a, b and c are obtained by the process described above. These coefficients will depend on a number of factors including the particular mechanical arrangement of the elliptical step apparatus. As an example, the coefficients that were determined for an elliptical exercise apparatus of the type 10 are: a=0.0348, b=0.0002, and c=0.2379.

Utilizing these equations, the distance traveled (DT) on an elliptical step apparatus can be calculated as DT=CL×M and displayed on the display 126D shown in FIG. 3.

In addition by using these calculations, speed in terms of miles per hour or minute per mile can also be displayed on the display 126B shown in FIG. 3 as described above. For example, speed in miles per hour can be calculated as (60×DT)/t or speed in minutes per mile can be calculated as t/DT and displayed at periodic intervals.

In certain circumstances, it might be desirable to modify and simplify the method described above of calculating distance traveled DT. One approach is to consider a measure of the calories burned per mile as a guide for modifying the calculation of DT. In this approach, the calculation of DT is modified to maintain a more constant calories/mile ratio for varying speed which also has the effect of decreasing DT at lower RPM and increasing DT at higher RPM that tends to conform with user perceptions of distance traveled. Specifically, this method involves obtaining the calorie/mile ratios for a number of users of varying weights on an elliptical exercise apparatus as well as a treadmill for comparison with the DT verses RPM curve as described above. Linear regression analysis can then be used to obtain an equation to calculate a modified DT ($DT_M$). In this case the equation has the form:

$$DT_M=(d\times\mathrm{RPM}+e)\times(t/60)$$

For an elliptical step apparatus of the type 10, examples of suitable values for the coefficients are: d=0.08 and e=0.5. As with the coefficients a, b, and c used in the equation for DT, the coefficients d and e will be dependent on a number of factors including the geometry of the foot path and mechanical structure of the elliptical step apparatus. Also, by modifying the equation for DT into a single linear equation, implementation in software to be executed by the microprocessor 92 shown in FIG. 2 is made simpler. It should be noted that the equation for $DT_M$ essentially reflects the criteria used to develop the equation for calculating DT.

The general principles relating to the measurement of distance on an elliptical step type apparatus discussed above also can relate to an elliptical step apparatus where the length of a user's stride can be varied as shown in FIGS. 1, 2, 4 and 5. Such an apparatus is described below in connection with FIG. 12 and FIG. 13.

Figure 12:
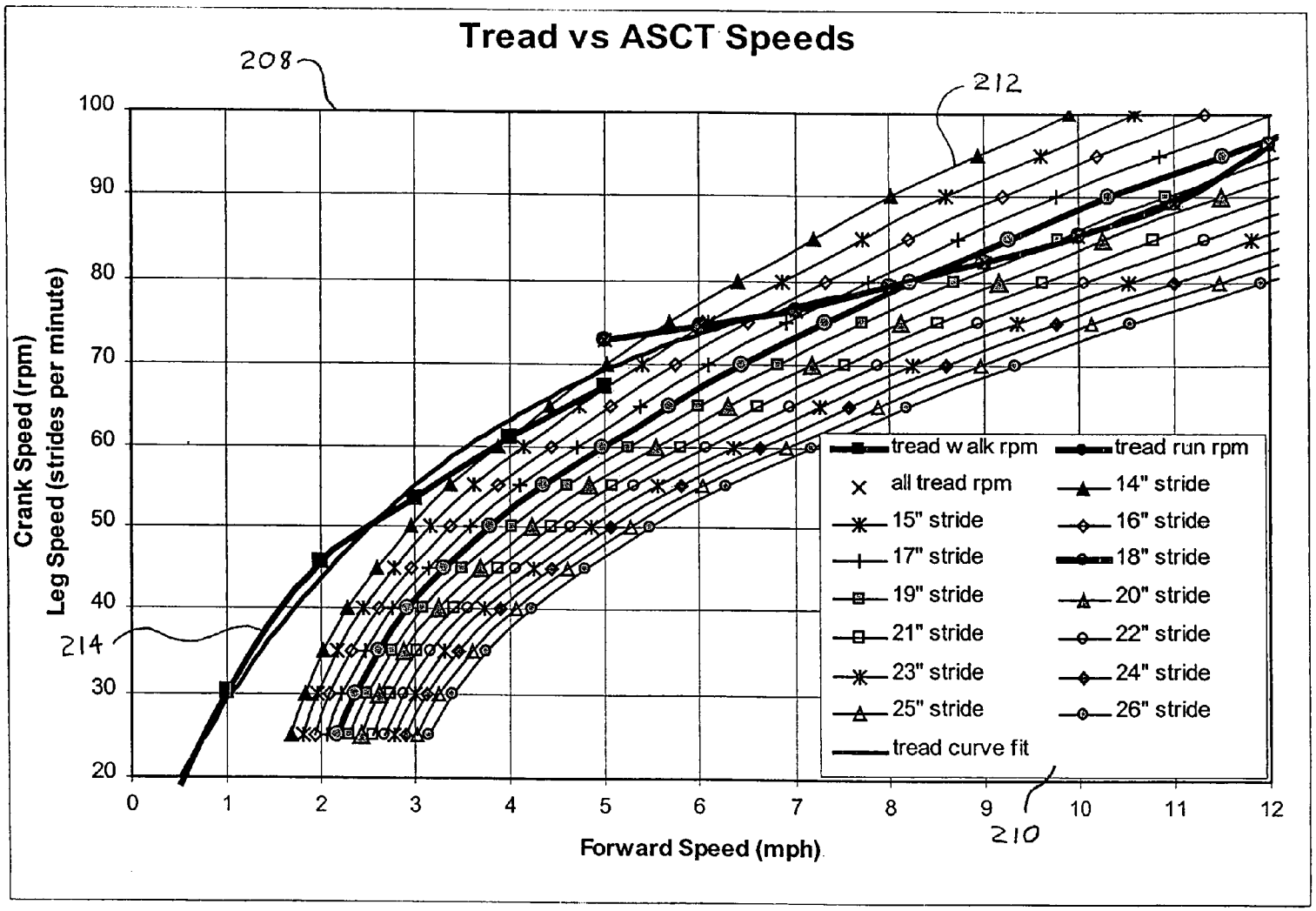
FIG. 12 is a graph illustrating a first method of forward speed measurement in an elliptical stepping exercise apparatus of the type shown in FIG. 1 having an adjustable stride length.

FIG. 12 is a graph 208 illustrating a first approach to estimating forward speed over the ground as a function of crank speed in RPM for an elliptical stepping apparatus having 13 different stride lengths ranging form 14 inches to 26 inches. A key 210 on the right hand side of the graph on FIG. 12 serves to identify the symbol for each stride length line on the graph. In this case, the functional relationship between crank speed and forward speed is non-linear. Thus, the basic format of the forward speed equation is MPH=(a*RPM$^2$−b*RPM+c)*[(stride in inches)/d]. The coefficients a, b, c, and d are all computed through comparative analysis of treadmills using criteria as discussed above such as contact distance, calories burned, heart rate and user feedback. Example values of these coefficients are a=0.00105, b=0.0125, c=0.7, and d=14.

Strides per minute of a treadmill is equated with the crank speed of an elliptical machine as illustrated on the y axis of the chart on FIG. 12. Equating these two variables is useful for approximating an elliptical machine curve such as a curve 212 for the 14 inch stride. In FIG. 12, a treadmill curve 214 provides a good basis for the variable stride curves 212 and thus allows for a more accurate model for measuring distance. In this example, the variable stride curves such as 212 have been made nonlinear to closely follow the nonlinear treadmill curve 214.

Figure 13:
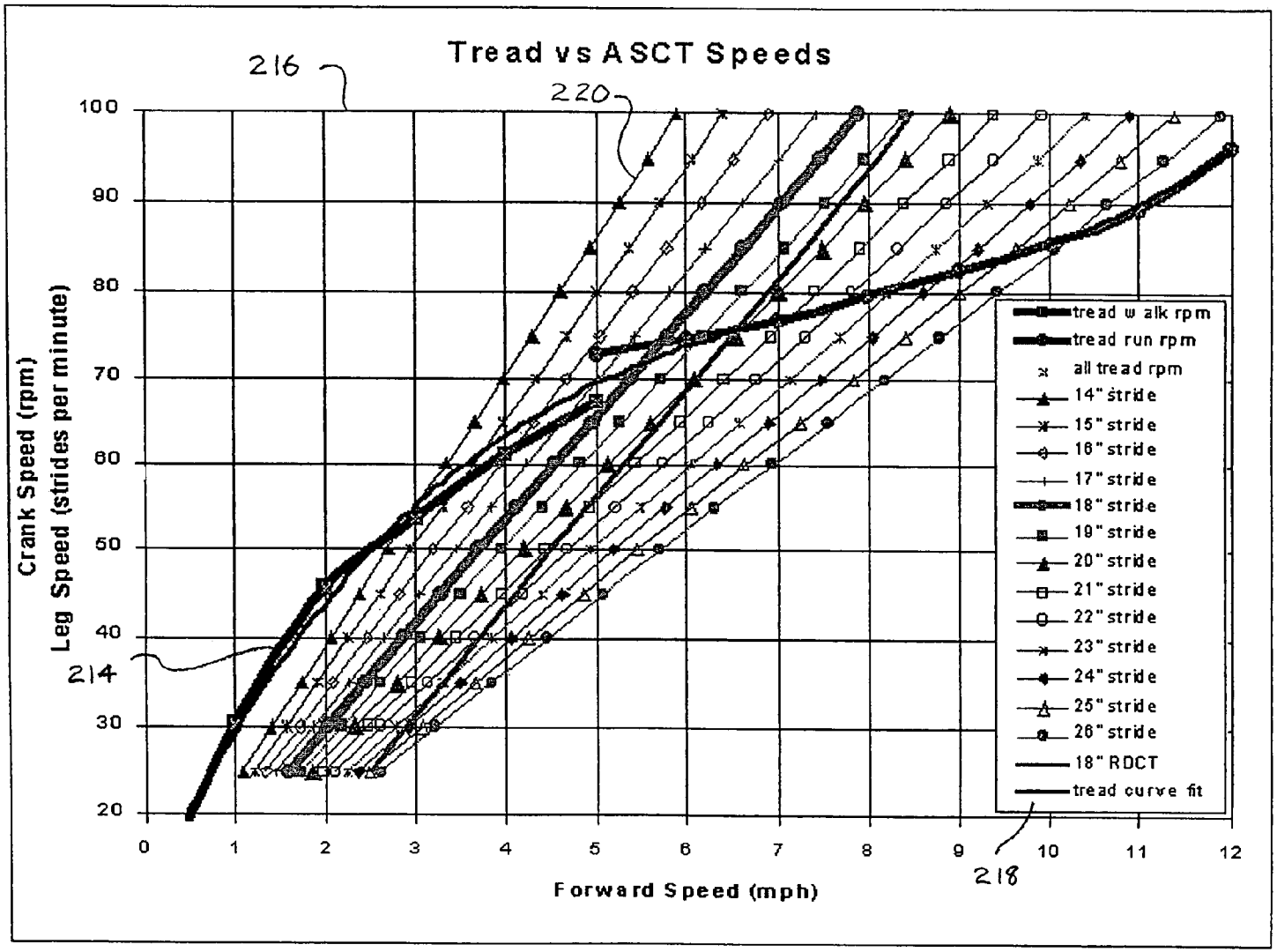
FIG. 13 is a graph illustrating a second method of forward speed measurement in an elliptical stepping exercise apparatus of the type shown in FIG. 1 having an adjustable stride length.

FIG. 13 is a graph 216 illustrating a second approach to estimating forward speed over the ground as a function of crank speed in RPM for the elliptical stepping apparatus having 13 different stride lengths ranging form 14 inches to 26 inches. A key 218 on the right hand side of the graph of FIG. 13 serves to identify the symbol for each stride length line on the graph 216. In this case, the functional relationship between crank speed and forward speed is linear and of the form used in the modified DT equation ($DT_M$) described above and computed using the criteria discussed above. Thus, the basic format of the forward speed equation is y=mx+b where y is the forward speed, x is the crank speed in RPM, m is the slope of the equation and b is the intercept of the y axis. In particular, the equation describing a variable stride curve such as a curve 220 for a 14 inch stride is given by:

$$\text{Speed (MPH)}=[(0.005*(\text{stride in inches}))-0.009]*\mathrm{RPM}$$

where y=speed in mph, m=(0.005*(stride in inches)−0.009), x=RPM and b=0 such that all of the variable stride curves including the curve 220 intersect the axes at the origin. As can be seen from the graph of FIG. 13, the slope m decreases with stride length. In the example of the curve 220 for a stride length of 14 inches at a crank speed of 100 RPM, the computed forward speed will be about 6 mph whereas for a stride length of 26 inches the forward speed will be almost 12 mph. In this particular embodiment, the value of the slope m decreases in a substantially linear manner with increasing stride length. Also illustrated in FIG. 13 is a general directional trend between the treadmill curve 214 and the variable stride curves such as the curve 220 linking them together in terms of crank speed (strides per minute) and forward speed performance.

We claim:

1. A method of computing distance traveled by a user for a predetermined time on an elliptical step exercise apparatus having pedals that travel in a generally elliptical path, a speed sensor for measuring the pedal speed in revolutions per minute, a control system and a display comprising the steps of:

determining the length of the elliptical path;

utilizing the control system to multiply said path length by a constant having a value in the range of about 60% to 80% to obtain a modified path length;

utilizing the control system to multiply said modified path length by the speed of rotation of the pedals obtained from the speed sensor and the predetermined time to obtain the distance traveled and utilizing the control system to display said distance traveled on the display.

2. The method of claim 1 including the additional step of utilizing the control system to multiply the distance traveled by a multiplier of the speed of rotation of the pedals to obtain a modified distance traveled that serves to compensate for simulated increasing user stride length with increasing pedal speed.

3. The method of claim 2 wherein said multiplier is substantially linear.

4. The method of claim 2 wherein said multiplier is nonlinear and decreases with increasing pedal speed.

5. The method of claim 4 wherein said multiplier is substantially linear for lower pedal speeds and said nonlinear decrease occurs at higher pedal speeds.

6. The method of claim 5 wherein said multiplier takes the form of:

$$M=(a\times\mathrm{RPM})\times(-b\times\mathrm{RPM}^2)+c$$

where M is said multiplier, RPM is the pedal speed measured in revolutions per minute, and a, b and c are coefficients.

7. The method of claim 1 wherein said constant corresponds to the approximate portion of the elliptical path upon which a significant contact force is applied by the user to the foot pedals.

8. The method of claim 7 wherein said constant is approximately 75% of said length of the elliptical path.

* * * * *